US007089716B2

(12) United States Patent
Sterling

(10) Patent No.: US 7,089,716 B2
(45) Date of Patent: Aug. 15, 2006

(54) APPARATUS FOR FORMING AND PACKAGING FLEXIBLE DUCTING

(75) Inventor: Michael William Sterling, Eltham (AU)

(73) Assignee: Westaflex (Australia) Pty. Ltd., Victoria (AU)

( * ) Notice: Subject to any disclaimer, the term of this patent is extended or adjusted under 35 U.S.C. 154(b) by 0 days.

(21) Appl. No.: 10/344,985

(22) PCT Filed: Dec. 6, 2002

(86) PCT No.: PCT/AU02/01658

§ 371 (c)(1),
(2), (4) Date: Mar. 11, 2004

(87) PCT Pub. No.: WO03/047979

PCT Pub. Date: Jun. 12, 2003

(65) Prior Publication Data

US 2004/0128952 A1 Jul. 8, 2004

(51) Int. Cl.
*B65B 63/02* (2006.01)

(52) U.S. Cl. ..... 53/438; 53/436; 53/469; 53/527

(58) Field of Classification Search ..... 53/436, 53/438, 469, 527
See application file for complete search history.

(56) References Cited

U.S. PATENT DOCUMENTS

| | | | | |
|---|---|---|---|---|
| 3,827,210 A | | 8/1974 | Smalley et al. | |
| 3,939,622 A | * | 2/1976 | Murphy et al. | 53/432 |
| 4,592,193 A | * | 6/1986 | Gustavsson | 53/530 |
| 4,619,103 A | * | 10/1986 | Kenrick | 53/432 |
| 4,817,365 A | | 4/1989 | Yawberg et al. | |
| 4,934,125 A | * | 6/1990 | Baker | 53/436 |
| 5,785,091 A | | 7/1998 | Barker, II | |
| 5,987,858 A | * | 11/1999 | Long | 53/529 |
| 6,079,187 A | * | 6/2000 | Velderman et al. | 53/436 |
| 2005/0016130 A1 | * | 1/2005 | Matsumoto | 53/439 |

FOREIGN PATENT DOCUMENTS

| | | | |
|---|---|---|---|
| AU | 23039/84 A | | 7/1985 |
| FR | 2 784 970 A1 | | 4/2000 |
| JP | 52-017992 | * | 10/1977 |
| JP | 10-323798 | * | 8/1998 |

* cited by examiner

*Primary Examiner*—Scott A. Smith
*Assistant Examiner*—Gloria R. Weeks
(74) *Attorney, Agent, or Firm*—Sughrue Mion, PLLC

(57) ABSTRACT

Flexible ducting apparatus includes a packaging station and compression station, a support trough for supporting the ducting in the packaging station and compression station, and an actuating post which is arranged to engage a leading end of a length of flexible ducting to be packed and pull the length of ducting in a first direction through the packaging station into the compression station. The apparatus includes a control device to cause movement of a stop member into an operative position in the packaging station downstream of a trailing end of the length of ducting, the control device then being operative to cause the actuating post to execute a second stroke in the opposite direction to the first stroke so that the trailing end of the length of ducting is compressed against the stop member in the packaging station whereby packaging can be placed about the compressed length of ducting in the packaging station. The apparatus is preferably associated with a duct forming apparatus so that the first stroke of the control device causes insulation and a jacket to be applied about a core of the ducting.

19 Claims, 23 Drawing Sheets

APPARATUS FOR FORMING AND PACKAGING FLEXIBLE DUCTING

This is a National Stage Entry of application No. PCT/AU02/01658 filed Dec. 6, 2002; the disclosure of which is incorporated herein by reference.

BACKGROUND OF TILE INVENTION

This invention relates to apparatus for forming and packaging flexible ducting.

More particularly, the invention relates to forming flexible ducting which is of a type which includes a core which is surrounded by a layer of insulating material. Normally the insulating material is in turn surrounded by a jacket such as sheet plastic material or metallic foil.

SUMMARY OF THE INVENTION

According to a first aspect of the invention there is provided apparatus for forming insulated ducting, the apparatus including a wrapping zone, first support means for supporting a roll of insulating material and permitting the introduction of the insulating material to the wrapping zone in a longitudinal direction, a trough to cause the insulating material to assume a generally U-shape when viewed in said longitudinal direction, second support means for supporting flexible ducting core in a collapsed state and for supplying the core so as to engage the insulating material in an expanded state and extend generally parallel to the insulating material and forming means which causes the U-shaped insulating material to be fully wrapped about the expanded ducting core.

Preferably further, the second support means includes a resilient finger which maintains the collapsed ducting core on the second support means.

Preferably further, the second forming means includes a funnel through which the insulating material and expanded ducting core pass.

Preferably further, the apparatus includes jacket gathering means for placing a tubular jacket in a gathered state on the exterior of the funnel, the arrangement being such that when the expanded ducting core, insulating layer and an end of the gathered jacket are pulled from the funnel, the completed ducting is formed with the flexible ducting core being surrounded by the insulating material which in turn is surrounded by the tubular jacket.

According to a second aspect of the invention there is provided flexible ducting packaging apparatus including support means for supporting the ducting, an actuating member which is mounted for longitudinal movement along the support means, said actuating member including engagement means for engaging an end of a length of flexible ducting to be packaged, control means for causing the actuating member to execute a first stroke in which a length of the ducting means is moved onto the support means and then to cause the actuating member to execute a second stroke, in the opposite direction to the first stroke, in which the length of flexible ducting is compressed against a stop member whereby the compressed flexible ducting can be placed within packaging.

Preferably, the packaging comprises a plastic bag.

Preferably, the packaging apparatus includes a bagging station and wherein the flexible ducting passes through said bagging station during the first stroke.

Preferably further, the bagging station includes means to move the stop member into the bagging station at the commencement of the second stroke.

Preferably further, the bagging station includes means to withdraw the stop member and actuating member after the packaging bag has been placed over the compressed flexible ducting.

Preferably further, the bagging station includes bag guiding means for facilitating placement of the bag over the compressed duct.

Preferably further, the bag guiding means are movable with said stop means.

Preferably further, the apparatus includes duct guide bars which extend above the support means for retaining the flexible ducting thereon during said first and second strokes.

Preferably further, parts of the guide bars move into the bagging station during the second stroke.

Preferably further, said parts of the guide bars are withdrawn from the bagging zone prior to placement of the bag over the compressed ducting.

The invention also provides a method of packaging flexible ducting including the steps of moving a length of the flexible ducting onto a support member in a first direction, compressing the flexible ducting against a stop member by moving the ducting in a second direction so that the length of ducting is compressed in a bagging station, holding the ducting in a compressed state in the bagging station and introducing the compressed ducting into the bag at the bagging station.

The invention also provides apparatus for forming insulated ducting, the apparatus including:

a wrapping zone;

first support means for supporting a roll of insulation material and permitting introduction of the insulating material to the wrapping zone in a longitudinal direction;

first forming means to cause the insulating material to generally assume a U-shape when viewed in said longitudinal direction;

second support means for supporting ducting in a collapsed state and for supplying ducting to engage the insulating material in an expanded state and extend generally parallel to the insulating material; and second forming means which causes the U-shaped insulating material to be substantially fully wrapped around the expanded ducting.

In accordance with a further aspect of the invention, the duct forming apparatus defined above can be aligned with the duct packaging apparatus as defined above so that the actuating member can be operated to cause the flexible ducting to move through said second forming means.

In this arrangement, an operator can take the leading end of the ducting core and insulating layer from within the funnel together with the leading end of the tubular jacket on the outside of the funnel and introduce all of these ends into a pair of clamps on the actuating member. The operator then causes the apparatus to execute the first stroke. In doing so, the length of ducting is formed as it passes through the funnel and is directly transferred onto the support means. The operator can then separate the trailing edge of the insulating material because it is being fed from a continuous roll. This minimises handling of the duct prior to packaging and also is very efficient in terms of floor space required because no storage space is required for the completed lengths of ducting prior to compression and packaging. Also, no separate floor space is required for machinery which is required to form the duct and package the duct because these can essentially occur as part of the same operation.

After the operator has separated the trailing end of the insulating material, it can be fed into the duct packaging apparatus in readiness for the next length of ducting to be produced.

BRIEF DESCRIPTION OF THE DRAWINGS

The invention will now be further described with reference to the accompanying drawings, in which.

DETAILED DESCRIPTION OF THE INVENTION

Figure 1:
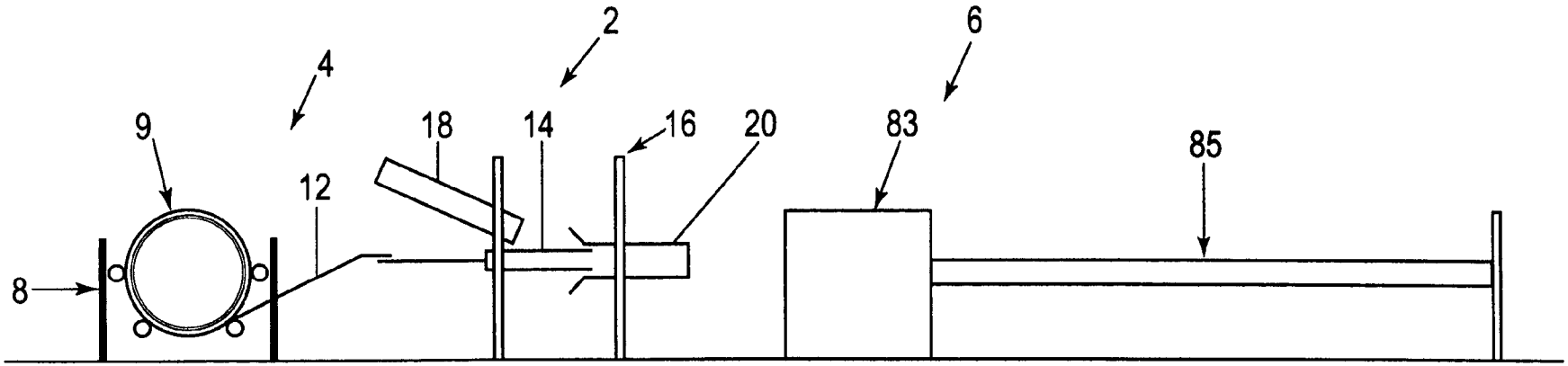
FIG. 1 is a schematic side view of duct forming apparatus and duct packaging apparatus of the invention.

FIG. 1 diagrammatically shows apparatus 2 of the invention, the apparatus 2 generally comprising duct forming apparatus 4 and duct packaging apparatus 6. As will be described below, the apparatus 4 and 6 are adjacent to one another and aligned with one another so that the duct which is produced in the forming apparatus 4 can be fed directly into the packaging apparatus 6. It will be appreciated, however, that the two parts of the apparatus 2 need not be so aligned.

The duct forming apparatus 4 will now be described in more detail with reference to FIGS. 1 to 8.

The duct forming apparatus includes a roller support 8 for a roll 9 of insulating material which may comprise fibreglass, polyfibre or other insulating material having a thickness in the range 25 to 75 mm. The width of the roll 9 is such that it can be fully wrapped about the outer circumference of a flexible duct core 10.

Figure 2:
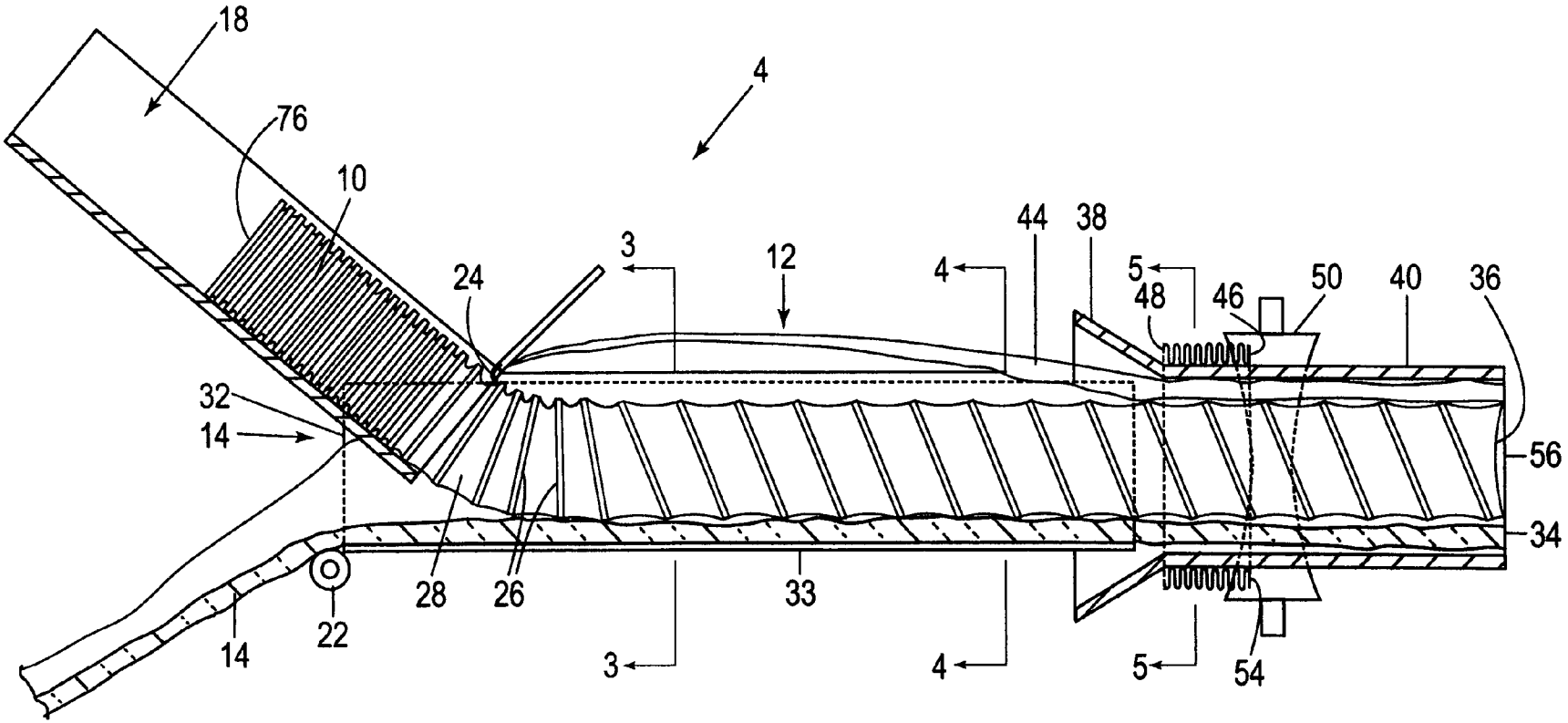
FIG. 2 is a schematic sectional view through the duct forming apparatus.

A layer 12 of insulating material is fed to a forming trough 14 which is supported by means of a framework generally denoted by the reference numeral 16. The framework 16 also supports a core support trough 18 and a forming funnel 20. FIG. 2 illustrates these components in more detail. The framework 16 supports a roller 22 at the upstream end of the forming trough 14 so as to facilitate passage of the layer 12 of insulation into the trough 14. The core support trough 18 is inclined at an angle so that a duct core 10 in a collapsed state can be held therein by gravity. A resilient finger 24 is supported by the framework 16 and is arranged to engage the core 10 and prevent the whole of the core 10 from falling into the forming trough 14.

The flexible ducting core 10 is preferably of a type which includes a helical framework 26 which is typically an aluminum channel into which is seamed the edges of a flexible core fabric 28. Flexible ducting of this form is very well known and it can assume a collapsed state in which the convolutions of the helical frame 26 are adjacent to one another and an expanded condition in which the convolutions are spaced from one another and the flexible covering 28 is stretched between adjacent convolutions. In FIG. 2, the core 10 is collapsed in the trough 18 and expanded in the trough 14. As will be described below, the core 10 is pulled through the funnel 20 and the resilient finger 24 serves to hold the collapsed part of the core 10 in the trough as well as to ensure that the core 10 is expanded when it is in the trough 14.

Figure 5:
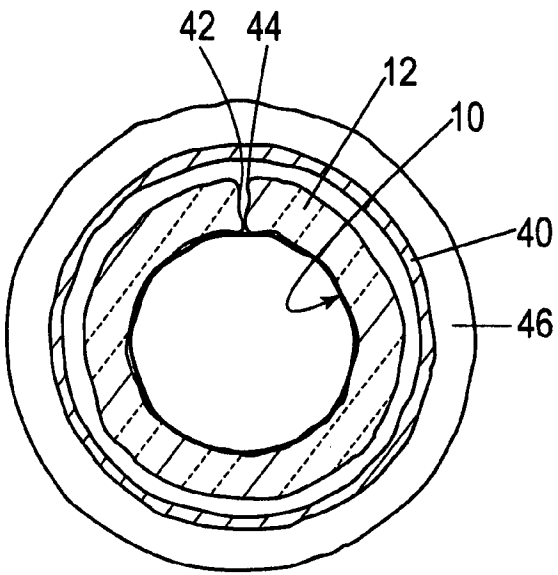
FIGS. 3, 4 and 5 are schematic cross-sectional views along the lines 3—3, 4—4 and 5—5 respectively.
Figure 3:
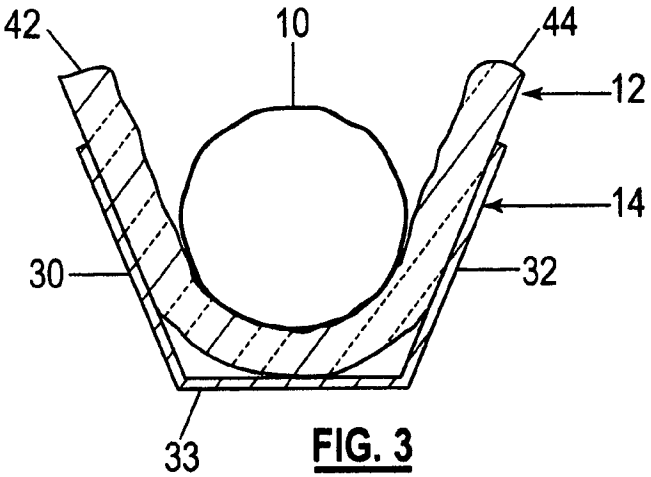
Figure 4:
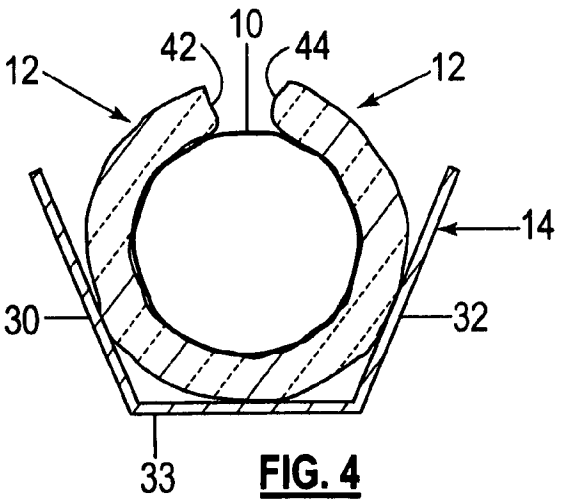

As best seen in FIGS. 3 and 4, the sides 30 and 32 of the trough 14 are splayed outwardly relative to the base 33 of the trough. This causes the layer 12 of insulation to assume a generally U-shape in cross-section, as shown in FIG. 3. The expanded core 10 is supplied to the centre of the U-shaped layer of insulation, as shown in FIG. 3. An operator (not shown) feeds the leading end 34 of the layer 12 and the leading end 36 of the core 10 into the interior of the funnel 20, as shown in FIG. 2. The funnel 20 includes a frustoconical portion 38 and a cylindrical portion 40. The frustoconical portion 38 serves to guide the lateral edges 42 and 44 of the layer 12 inwardly towards one another as the leading end 34 is moved into the frustoconical portion 38. This is diagrammatically illustrated in FIG. 4. Once the leading end 34 of the layer 12 and the leading end 36 of the core 10 are within the cylindrical portion 40 of the funnel, the lateral edges 42 and 44 of the layer of insulation abut one another as shown in FIG. 5. This forms a substantially continuous layer of insulating material about the core 10, as required.

Figure 6:
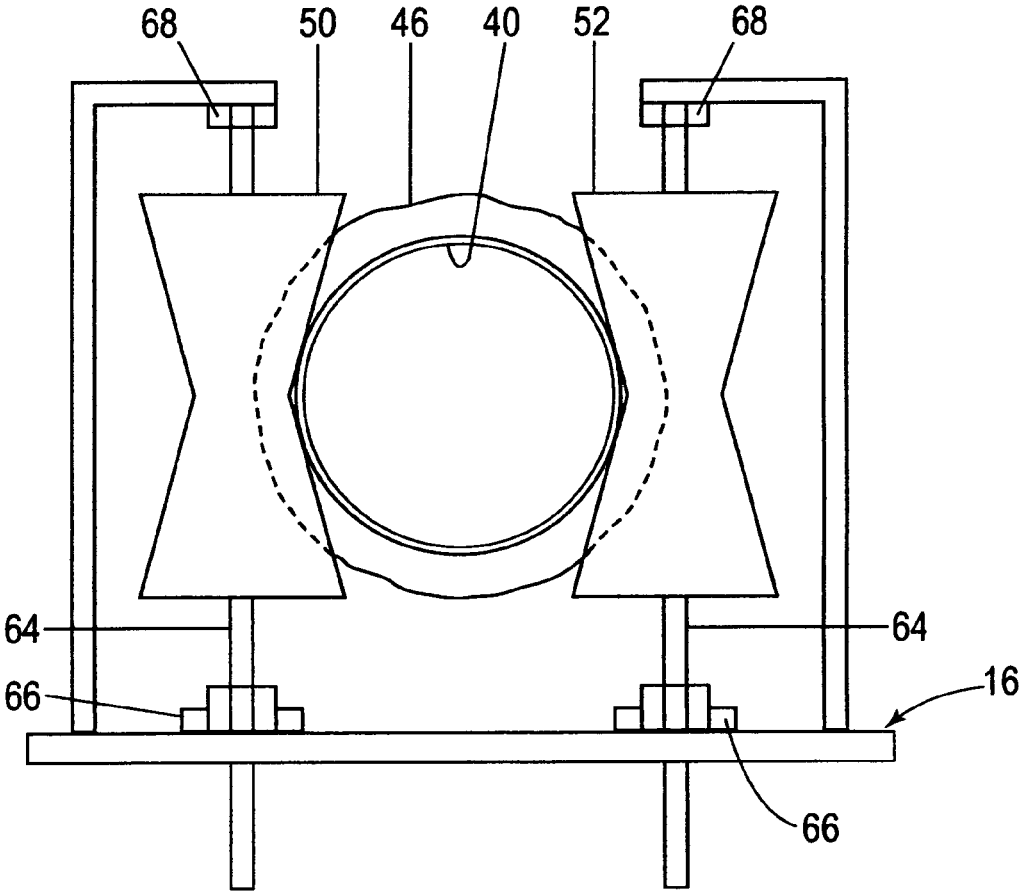
FIG. 6 is a schematic axial view of part of the duct forming apparatus.
Figure 7:
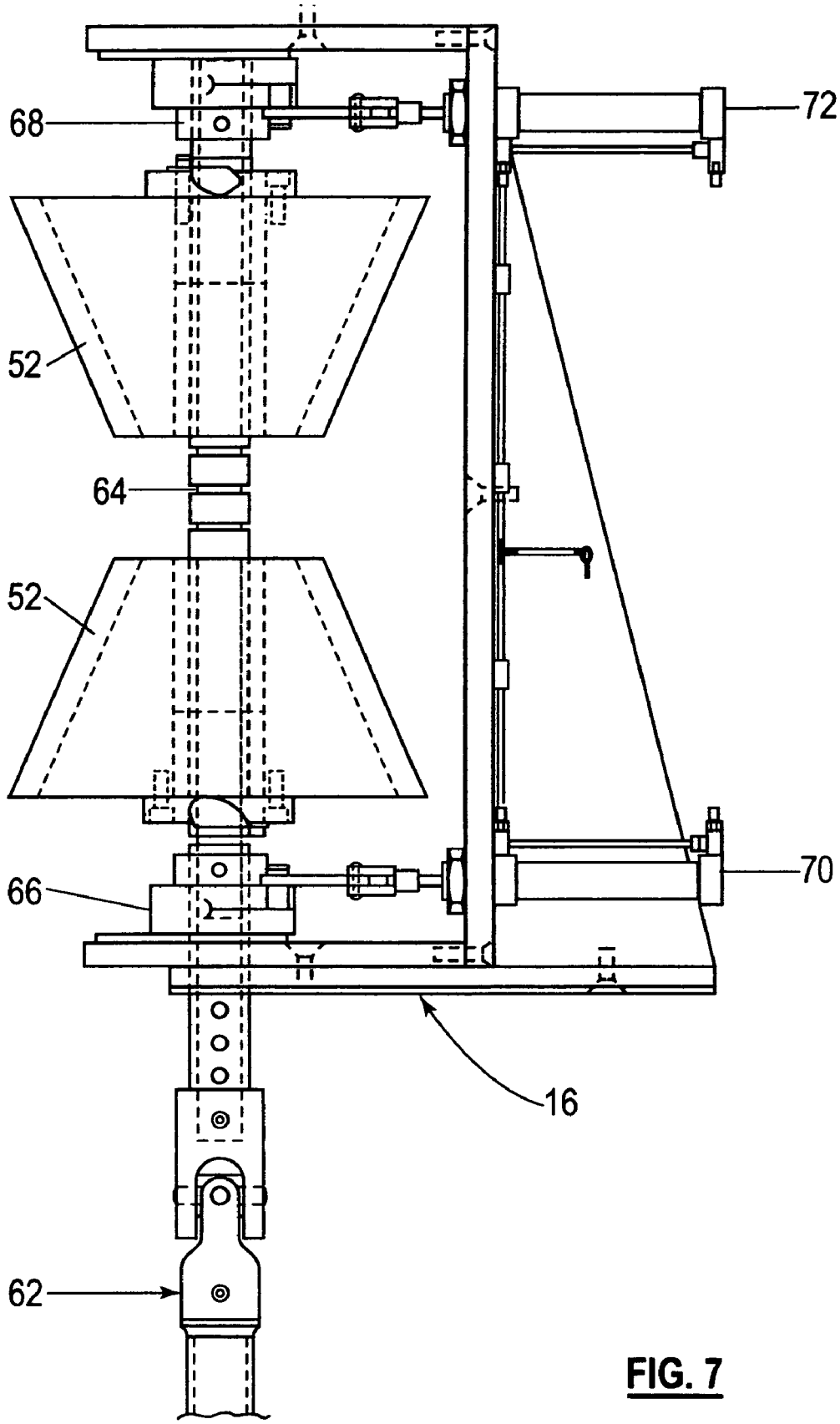
FIG. 7 is a fragmentary view of part of the duct forming apparatus.
Figure 8:
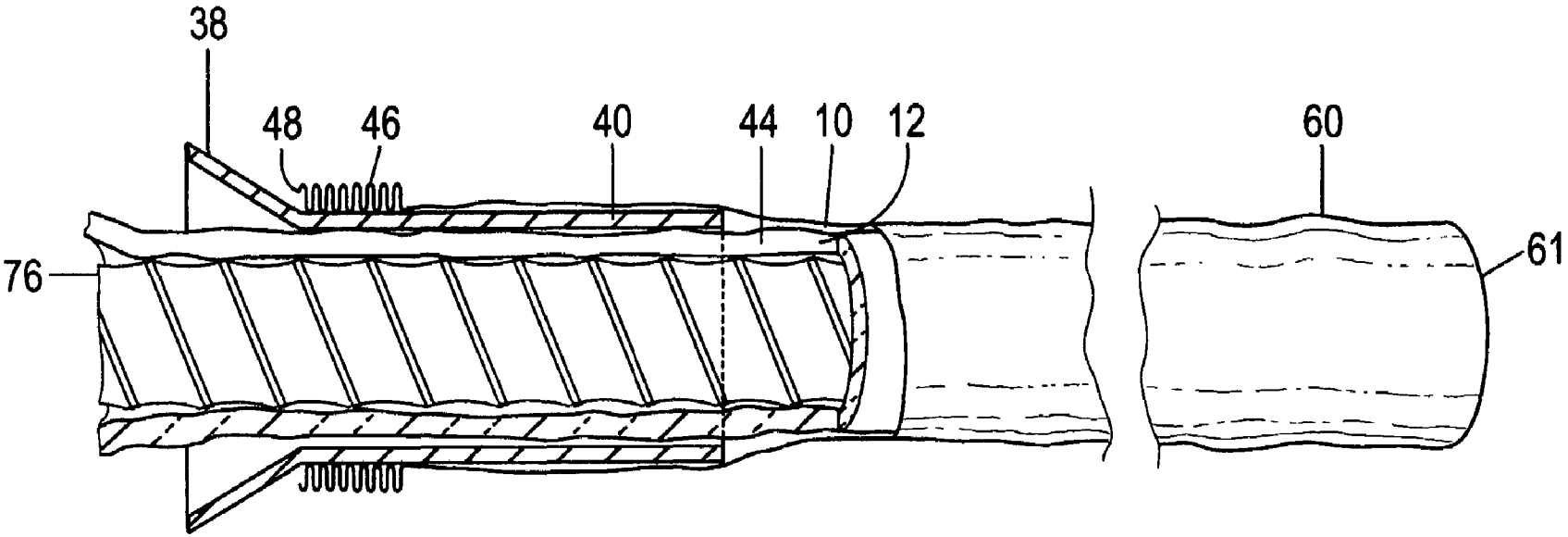
FIG. 8 is another cross-sectional view through part of the duct forming apparatus.

Normally the layer 12 of insulation is held in place by means of a moisture proof jacket 46. In the illustrated arrangement, the jacket 46 is in the form of a tube of flexible plastic material, preferably low density polyethylene, which when expanded has a diameter which is the same as or similar to the outer diameter of the insulating layer 12. In the illustrated apparatus, the jacket 46 is gathered onto the outer surface of the cylindrical portion 40 of the funnel, as shown in FIG. 5. This is preferably accomplished by an operator placing an end 48 over the end of the cylindrical portion 40 and introducing the end 48 between a pair of gathering rollers 50 and 52 which are located at either side of the cylindrical portion 40. As best seen in FIGS. 6 and 7, the rollers 50 and 52 are preferably in the form of opposed conical rollers which are formed from neoprene or coated with neoprene so as to grip the polyethylene material which forms the jacket 46. The rollers 50 and 52 are driven by motors (not shown) so as to gather the jacket 46 in a highly compressed state on the cylindrical portion 40 between the rollers and the frustoconical portion 38 of the funnel.

The rollers 50 and 52 are mounted in a way whereby they can be moved to a non-operative position in which they are no longer closely adjacent to the cylindrical portion 40. This enables an operator to grasp a leading end 54 of the jacket and move it to a position adjacent to the end 56 of the cylindrical portion 40 of the funnel. Once in this position, an operator can then grasp the leading end 36 of the core, leading end 34 of the insulating material and the leading end 54 of the jacket and pull the three elements simultaneously from the end 56 of the funnel. This thereby forms a length 60 of the completed ducting. In this arrangement the core 10 and jacket 46 are pre-cut to the length of the completed ducting and the operator cuts the layer 12 of insulating material at the trailing end of the length of ducting as mentioned above.

FIG. 7 schematically illustrates one arrangement for driving the rollers 50 and for moving them between their operative and non-operative position. A similar arrangement is provided for the rollers 52. It will be seen that a drive shaft 62 is coupled to a mounting shaft 64 on which the rollers 50 are mounted so that the rollers 50 rotate with the drive shaft 62. The shaft 64 is supported by means of a pair of support elements 66 and 68 which are eccentric relative to the shaft 64. The apparatus includes operating rams 70 and 72 which act between the framework 16 and the eccentric support elements 66 and 68. The arrangement is such that the rams 70 and 72 can be operated so as to cause displacement of the rollers 50 and 52 towards and away from the cylindrical portion 40 of the funnel 20, i.e. the roller 50 and 52 apply a constant pressure on the polyethylene sleeve. When the trailing end 76 of the length of core 10 passes out of the end 56 of the tunnel, the end 48 of the jacket should be adjacent thereto. The operator can then cut the insulating layer 12 at this point so as to form the complete length 60 of insulated duct, as diagrammatically shown in FIG. 8.

In accordance with the invention, the duct emerging from the end 56 of the tunnel is preferably introduced directly into the duct packaging apparatus 6 of the invention. This reduces unnecessary handling and storage of the completed duct and therefore is more efficient and requires less floor space.

The duct packaging apparatus 6 will now be more fully described with reference to FIGS. 9 to 27, The apparatus 6 includes a framework 80 which supports all of the elements of the apparatus. The framework includes a base 82 and uprights 84. The framework 80 includes lower support beams 86 and 88 and upper support beams 90 and 92 which extend substantially along the full length of the apparatus.

Figure 9:
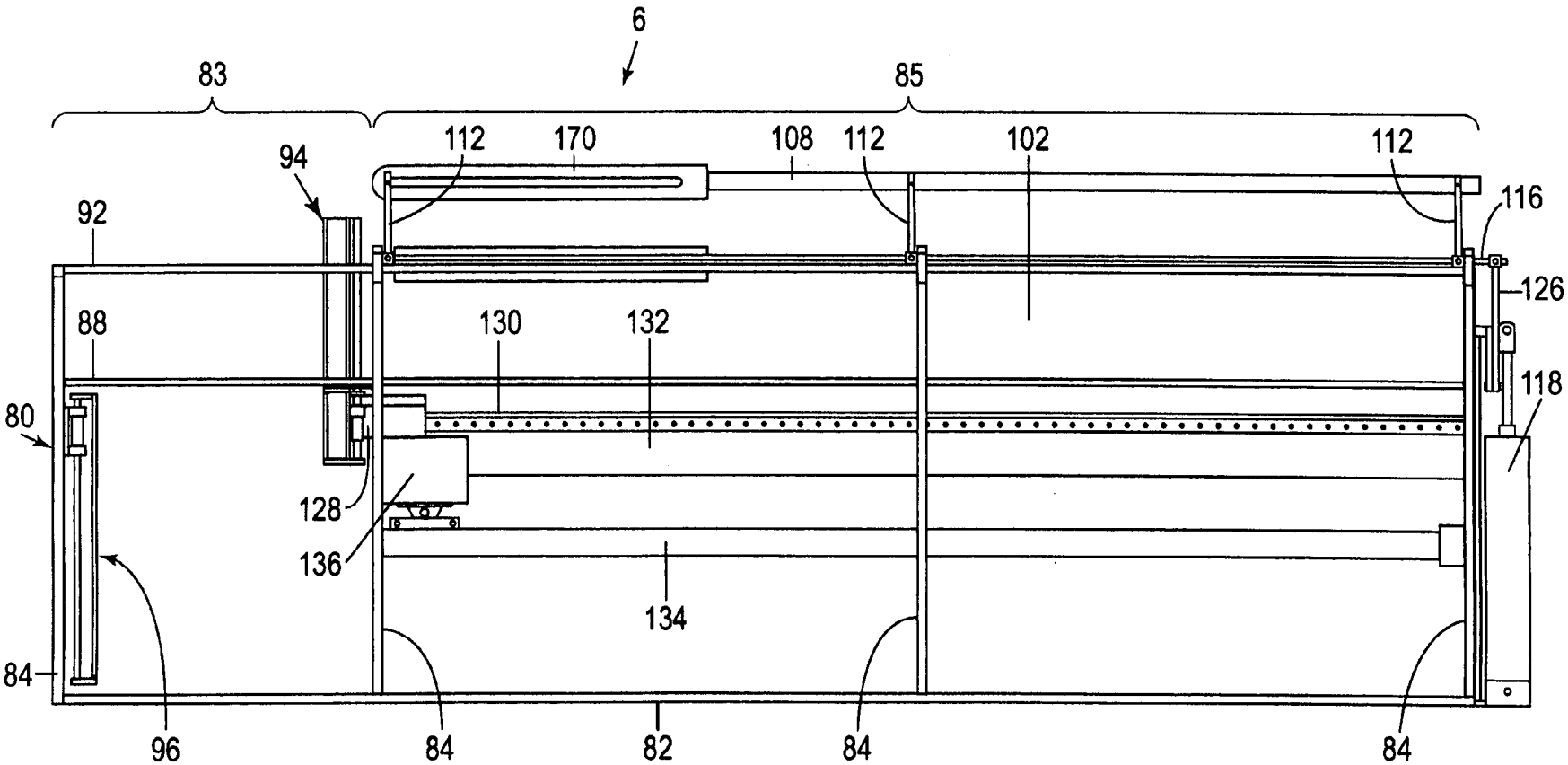
FIG. 9 is a schematic side view of duct packaging apparatus.
Figure 10:
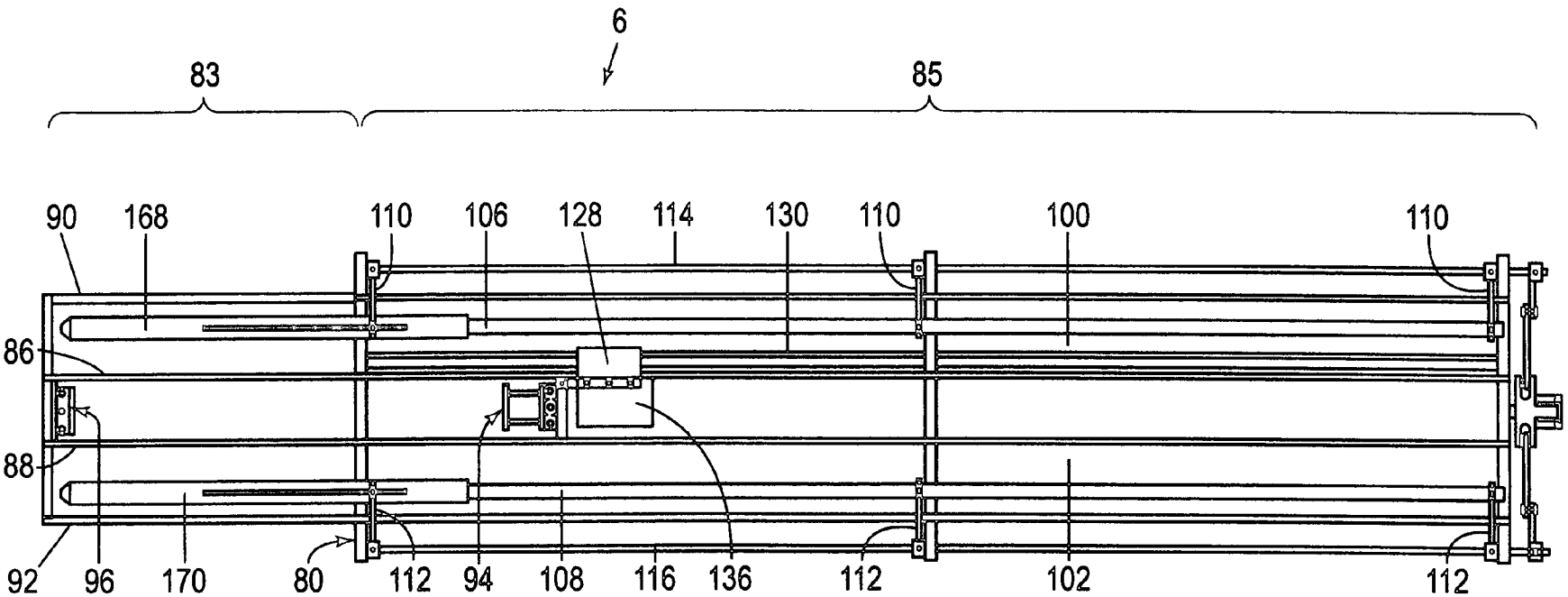
FIG. 10 is a schematic plan view of the duct packaging apparatus.
Figure 11:
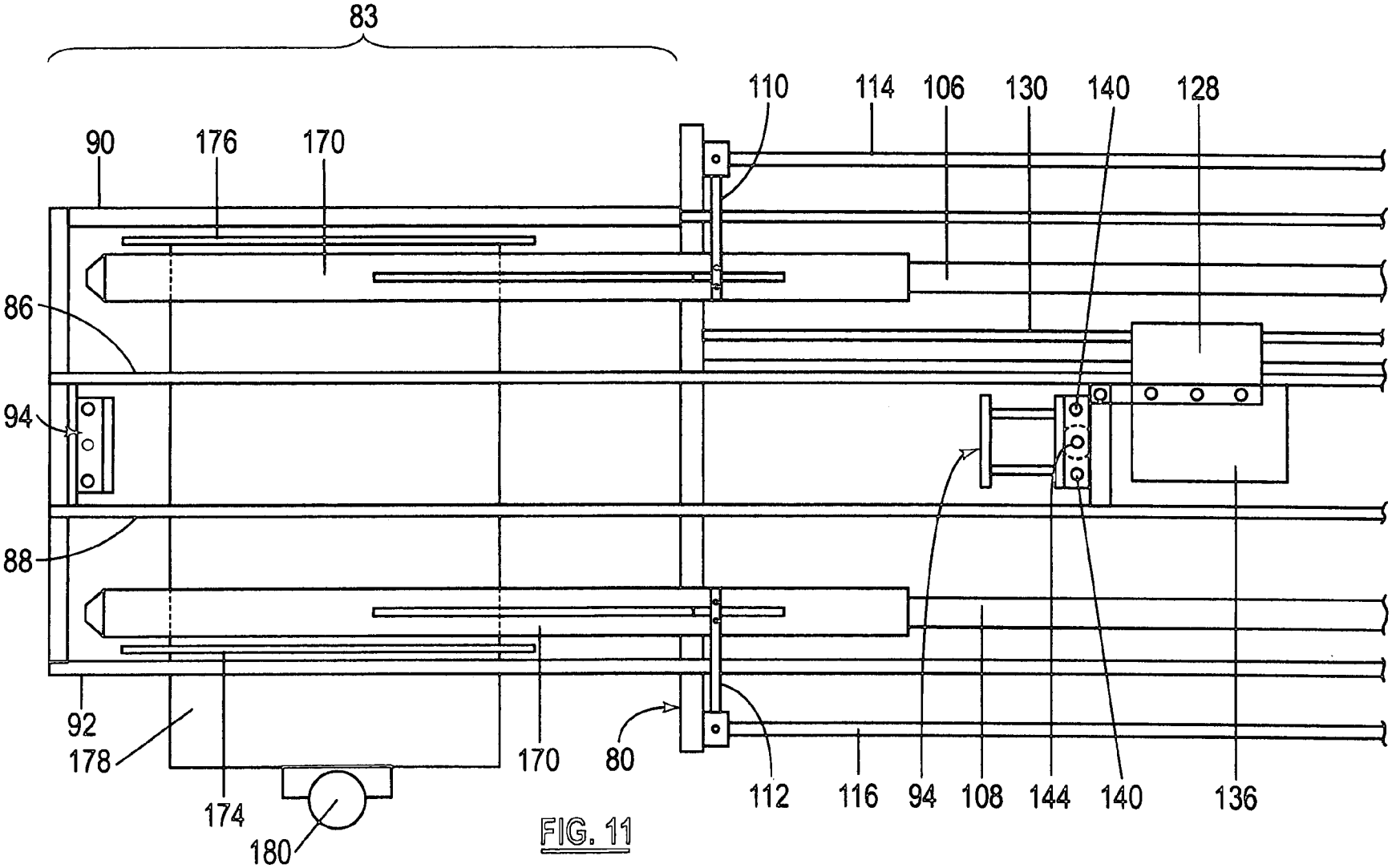
FIG. 11 is a more detailed plan view of part of the duct packaging apparatus.

The apparatus 6 generally includes a bagging station and a compressing station generally designated by the reference numerals 83 and 85 in FIG. 9. As will be described in more detail below, the leading end 61 is clamped to an actuating post 94 and is then pulled to the far end of the compressing station 85. At this stage the length 60 is supported within the compressing station 85. The actuating post 94 is then moved in the reverse direction so that the trailing end 63 of the duct is compressed against a stop post 96 which is moved into an operative position in the bagging station 83. The actuating post 94 moves to fully compress the length 60 of duct within the bagging station 83, the duct being held between the posts 94 and 96. An operator can then place an inverted plastic bag over the compressed length 60 of duct. Thereafter the posts 94 and 96 can be lowered so that the natural resilience of the duct will cause it to expand and be firmly held within the bag. The operator can then use adhesive tape or the like to close the mouth of the bag so as to complete the bagging operation.

Figure 12:
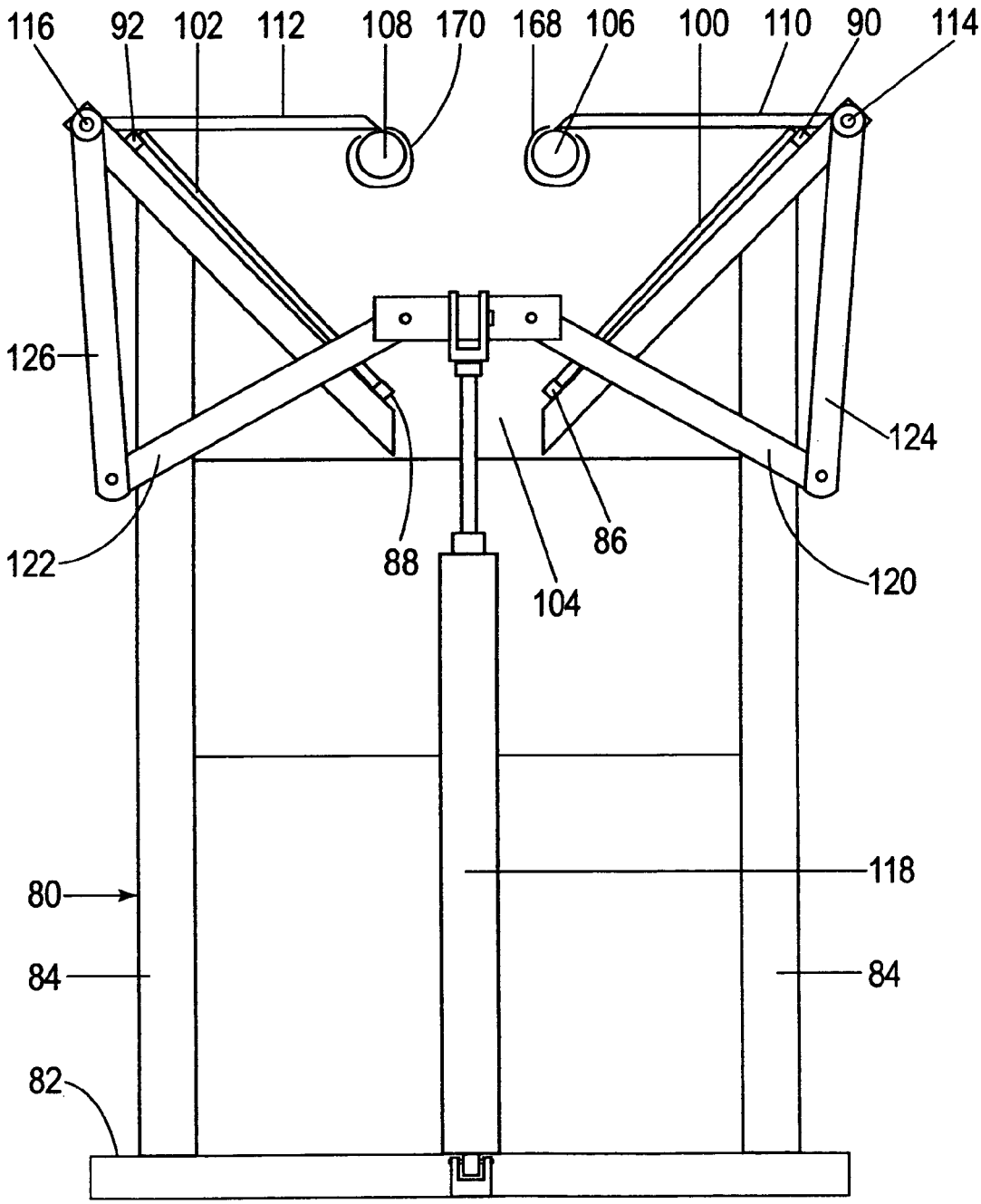
FIG. 12 is an end view of the duct packaging apparatus.
Figure 13:
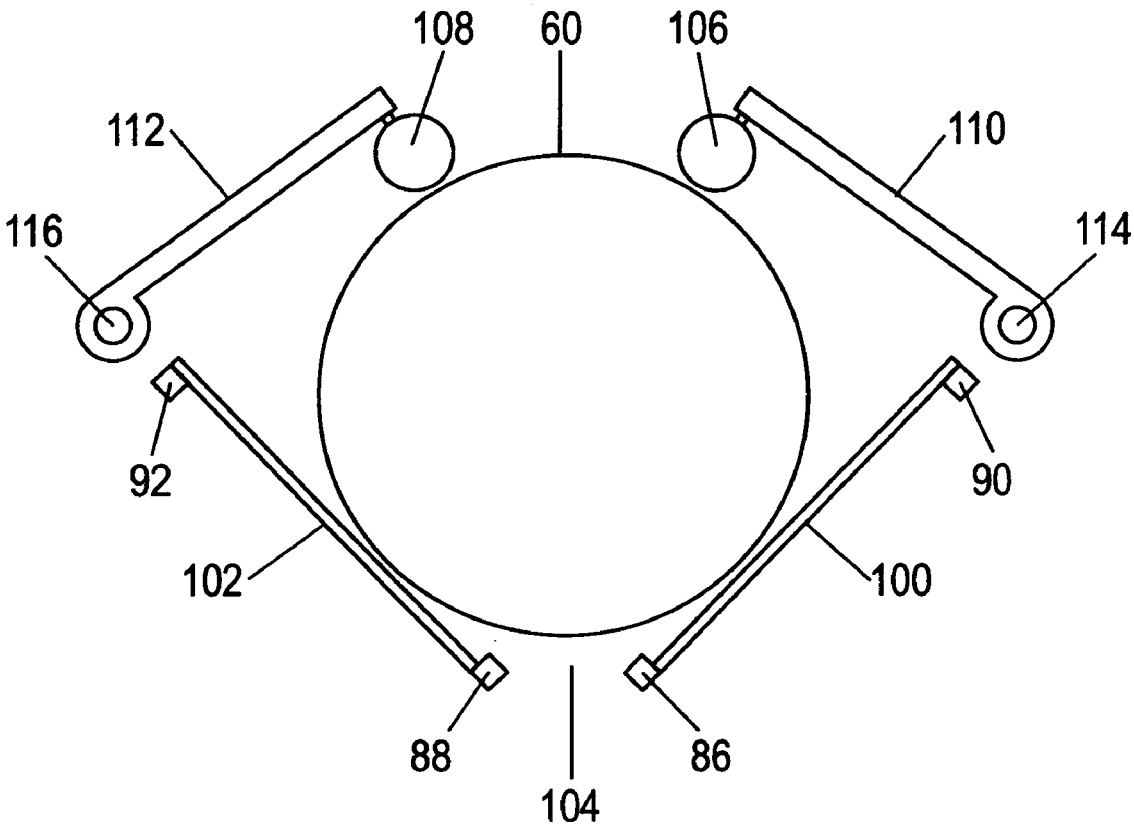
FIG. 13 is a schematic axial view showing guide bars.
Figure 14:
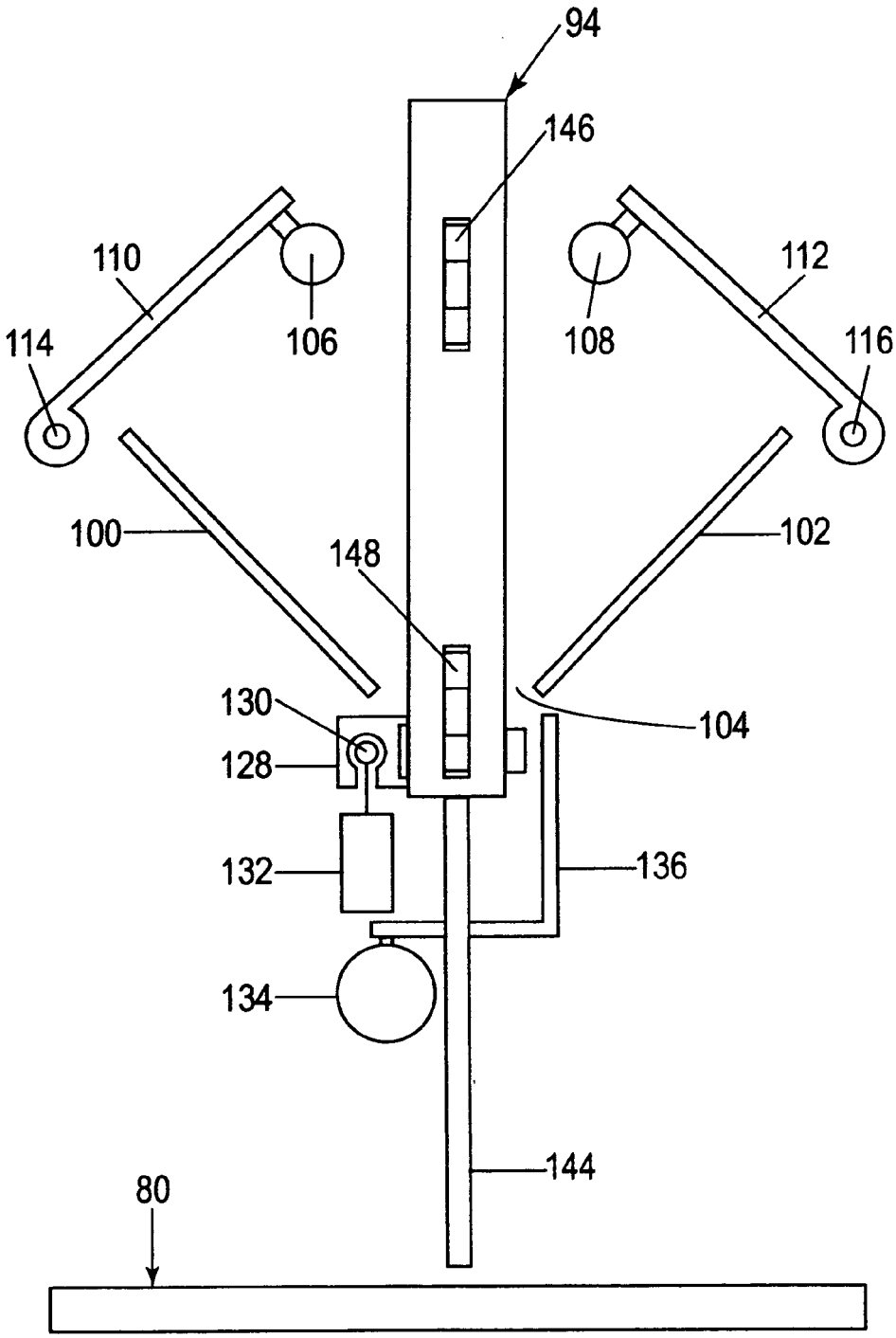
FIG. 14 is a schematic axial view showing support of the actuating post.

In the compressing station 85, the beams 86 and 90 provide a mounting for an elongate duct support plate 100. Similarly, the beams 88 and 92 support an elongate duct support plate 102. The plates 100 and 102 form a trough like structure with an opening 104 in the base thereof, as seen in FIG. 12. The opening 104 allows for longitudinal movement of the actuating post between the support plates 100 and 102, as will be described below. The length 60 of duct is supported by the plates 100 and 102 as shown in FIG. 13.

The apparatus also includes longitudinally extending guide bars 106 and 108 which are mounted on arms 110 and 112. The arms 110 and 112 are mounted on longitudinally extending shafts 114 and 116. The shafts 114 and 116 are rotatable so that the arms 110 and 112 can be adjusted in position so that the bars 106 and 108 lie adjacent to upper parts of the length 60 of duct so as to maintain it in a longitudinally extending condition in contact with the support plates 100 and 102, as diagrammatically illustrated in FIG. 13. FIG. 12 illustrates one arrangement for causing rotation of the shafts 114 and 116. In this arrangement a pneumatic ram 118 acts between the framework 80 and linkage arms 120 and 122 which are pivotally connected to the free ends of levers 124 and 126. The levers 124 and 126 are fixed to the shafts 114 and 116 respectively. Thus operation of the ram 118 causes movement of the guide bars 106 and 108 towards and away from the length 60 of ducting. Once the bars 106 and 108 are set in position, they do not need to be moved or adjusted until duct having a different diameter is being handled.

As mentioned above, the actuating post 94 is movable in a longitudinal direction through the opening 104 between the support plates 100 and 102. The actuating post 94 is supported on a slide block 128 which is arranged to slide along a longitudinally extending guide shaft 130. The guide shaft 130 is supported by means of a longitudinally extending beam 132 which forms part of the framework 80. An elongate pneumatic ram 134 extends beneath the beam 132. It has a carriage member 136 which is coupled to the slide block 128 such that operation of the ram causes longitudinal movement of the post 94 along the guide shaft 130. The ram 134 is preferably of the rodless type sold under the trademark ORIGA.

Figure 15:
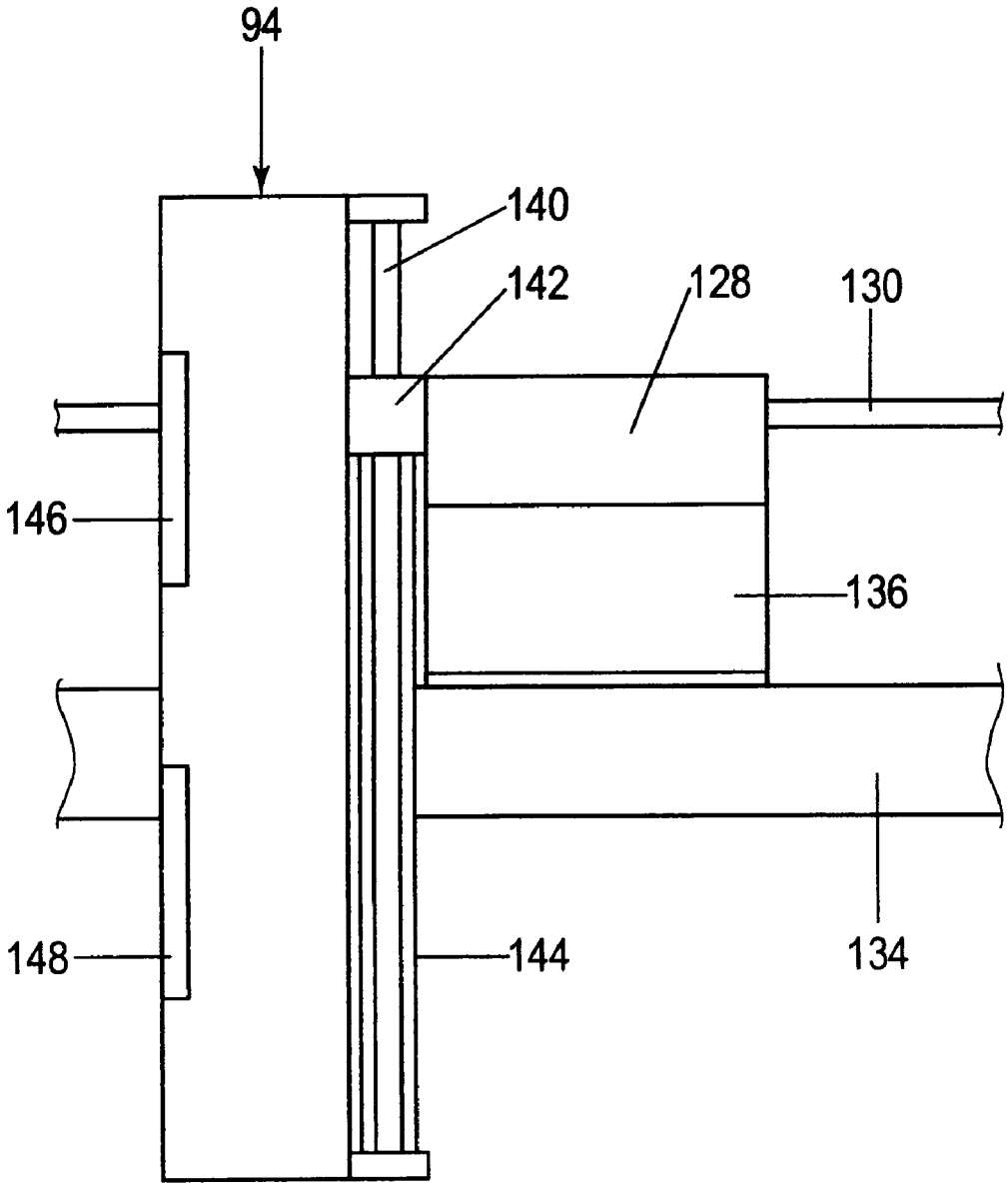
FIG. 15 is a fragmentary side view showing support of the actuating post.

The actuating post 94 is also movable vertically relative to the slide block 128. As best seen in FIG. 15, the post 94 includes a pair of guide shafts 140 which pass through support bearings 142 which are mounted on the slide block 128. An operating ram 144 is located between the guide shafts 140 and acts between a lower end of the post 94 and the support bearings 142 in order to control vertical movements of the actuating post 94.

Figure 16:
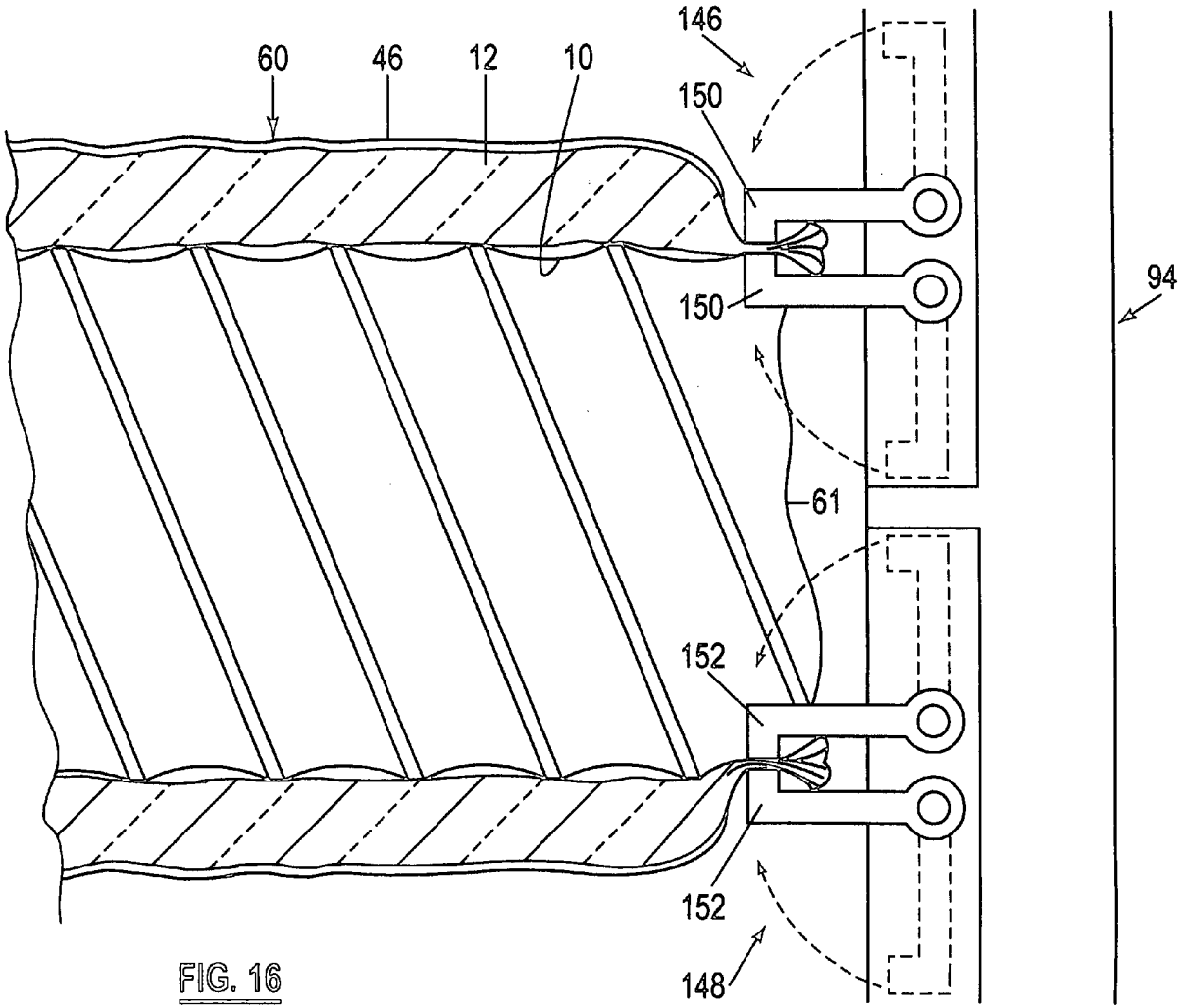
FIG. 16 is a more detailed cross-sectional view of the clamps on the actuating post.

The post 94 includes upper and lower clamps 146 and 148 which in use grip the upper and lower parts of the leading end 61 of the duct, as diagrammatically illustrated in FIG. 16. It will be seen that the clamps 146 and 148 include opposed pairs of jaw members 150 and 152 which, when operated, move from retracted positions within the post 94 to operative positions in which they clamp against the jacket 46, insulating layer 12 and core 10 adjacent to the leading end 61 of the length 60 of duct, as shown in FIG. 16. The clamps 146 and 148 can be of a known type such as Festo pneumatic clamps which are pneumatically operated by means of rams (not shown) located within the post 94.

Figure 23:
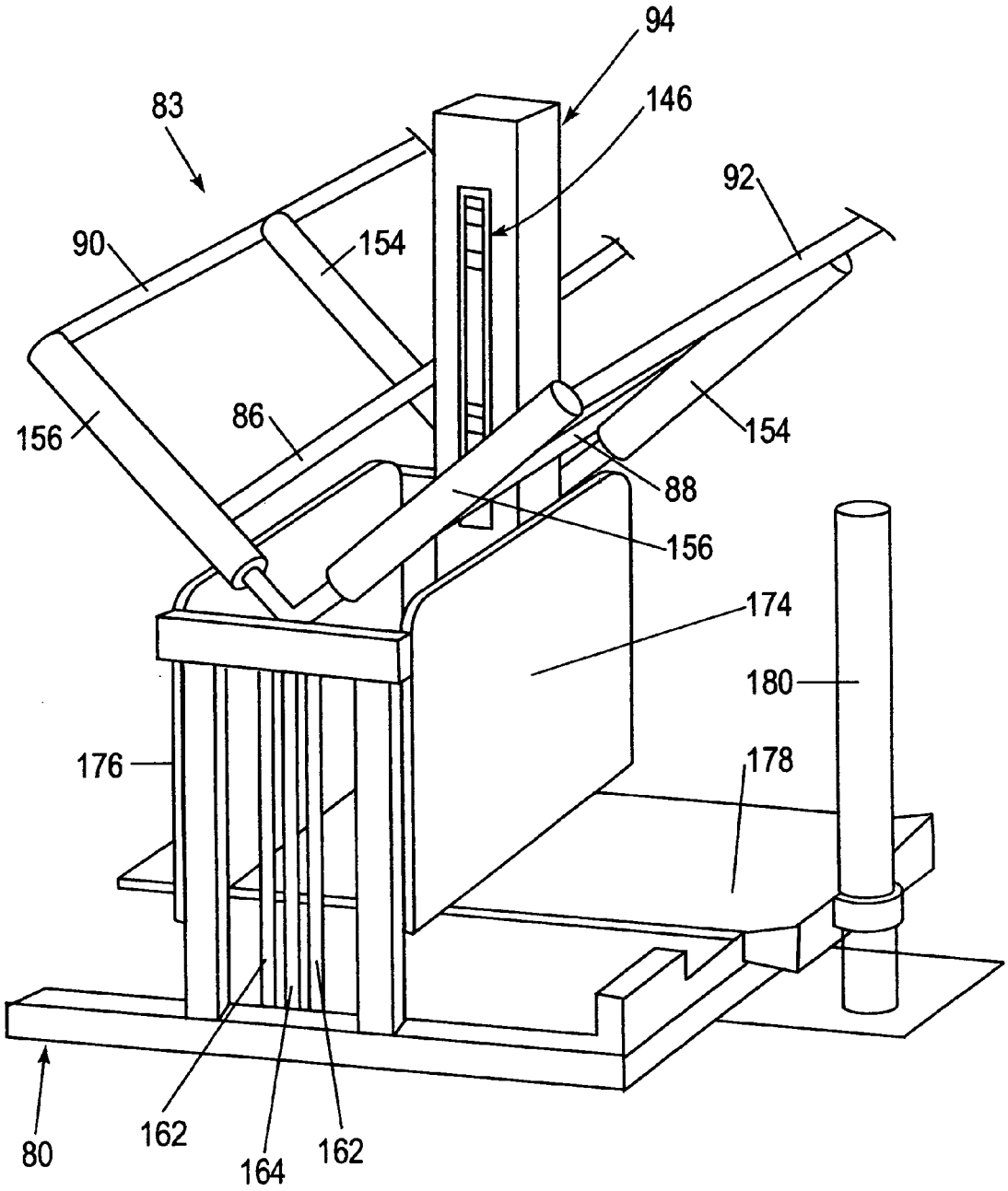
FIG. 23 is a fragmentary perspective view of the bagging station of the apparatus.

In use, an operator withdraws the leading end 61 of the duct from the funnel 20 and causes it to pass through the bagging station 83. The bagging station 83 may include upstream and downstream pairs of rollers 154 and 156 to facilitate movement of the duct therethrough, as shown in FIG. 23. In the illustrated arrangement, the rollers 154 and 156 are aligned with the ends of the support plates 100 and 102.

Figure 17:
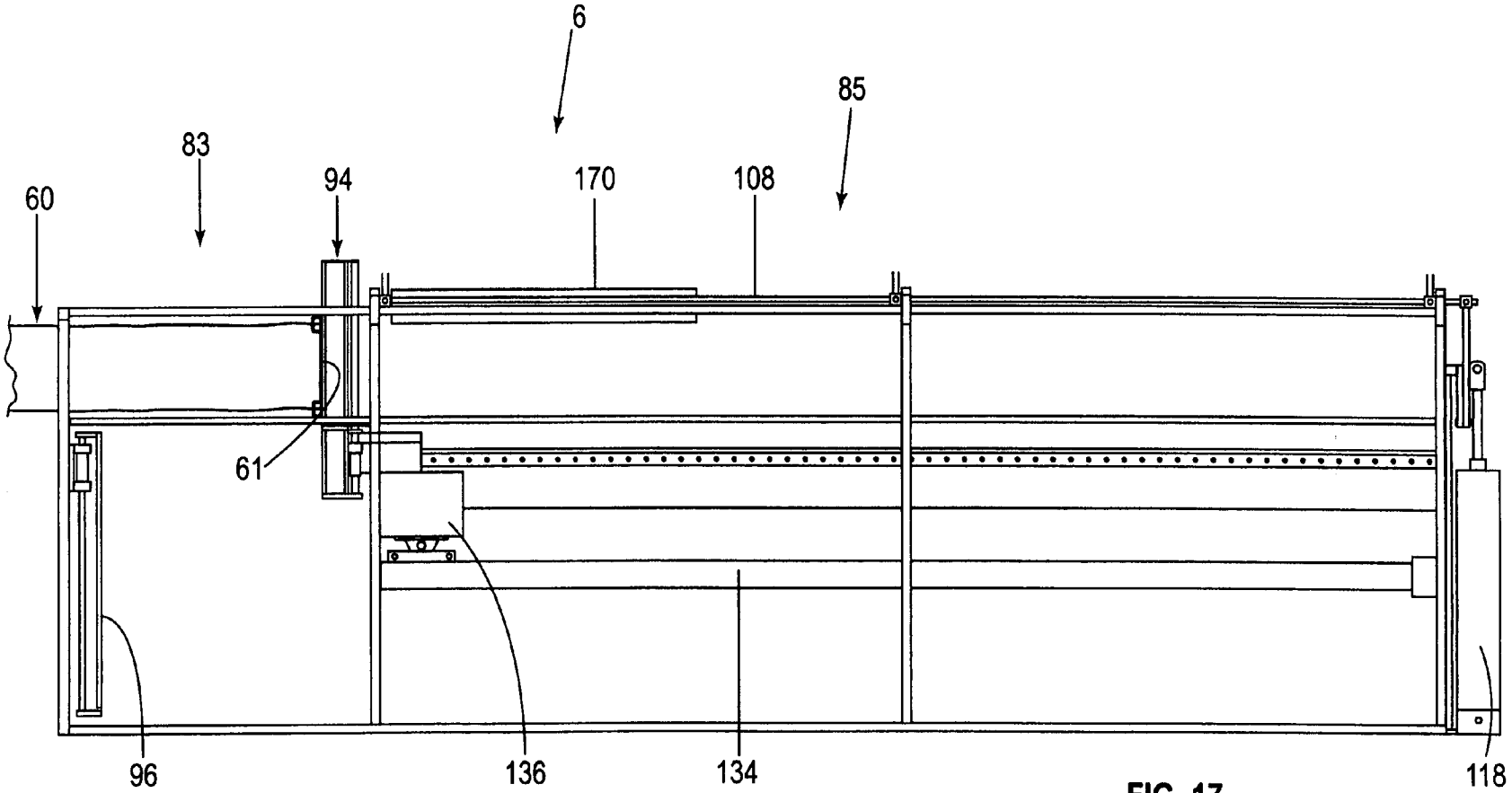
FIGS. 17 to 22 are schematic side views showing stages in the packaging process.
Figure 18:
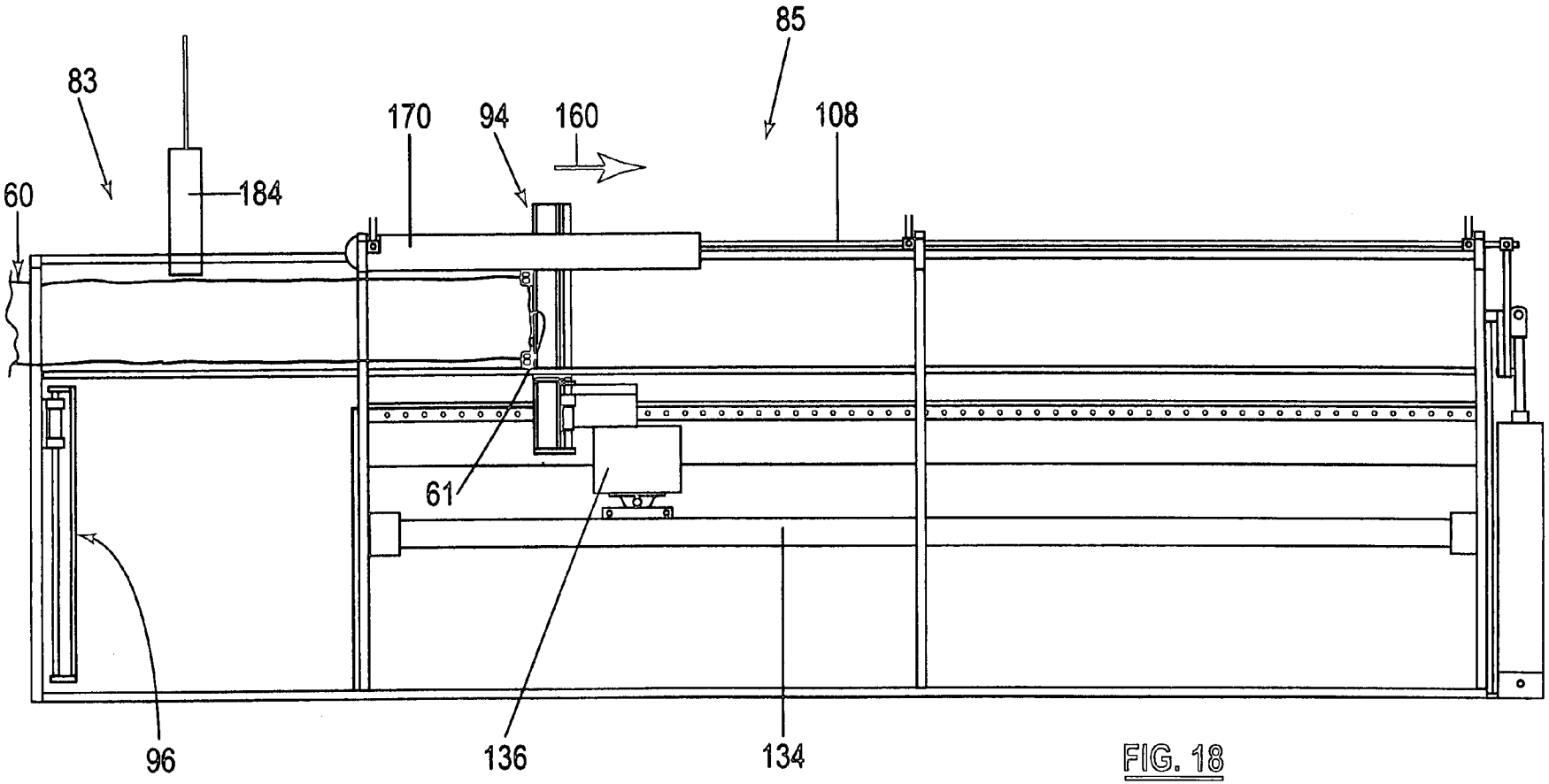
Figure 19:
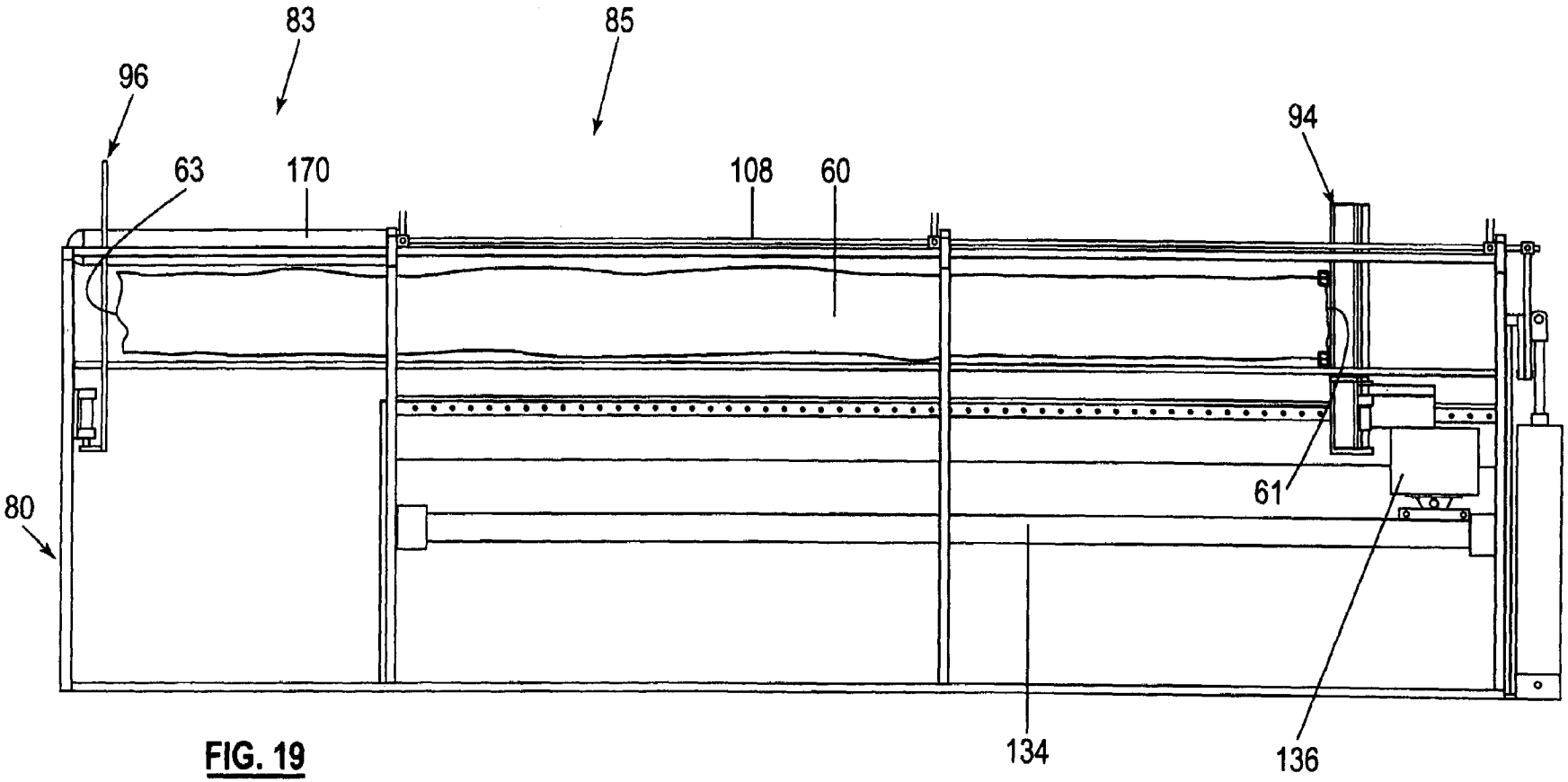
Figure 20:
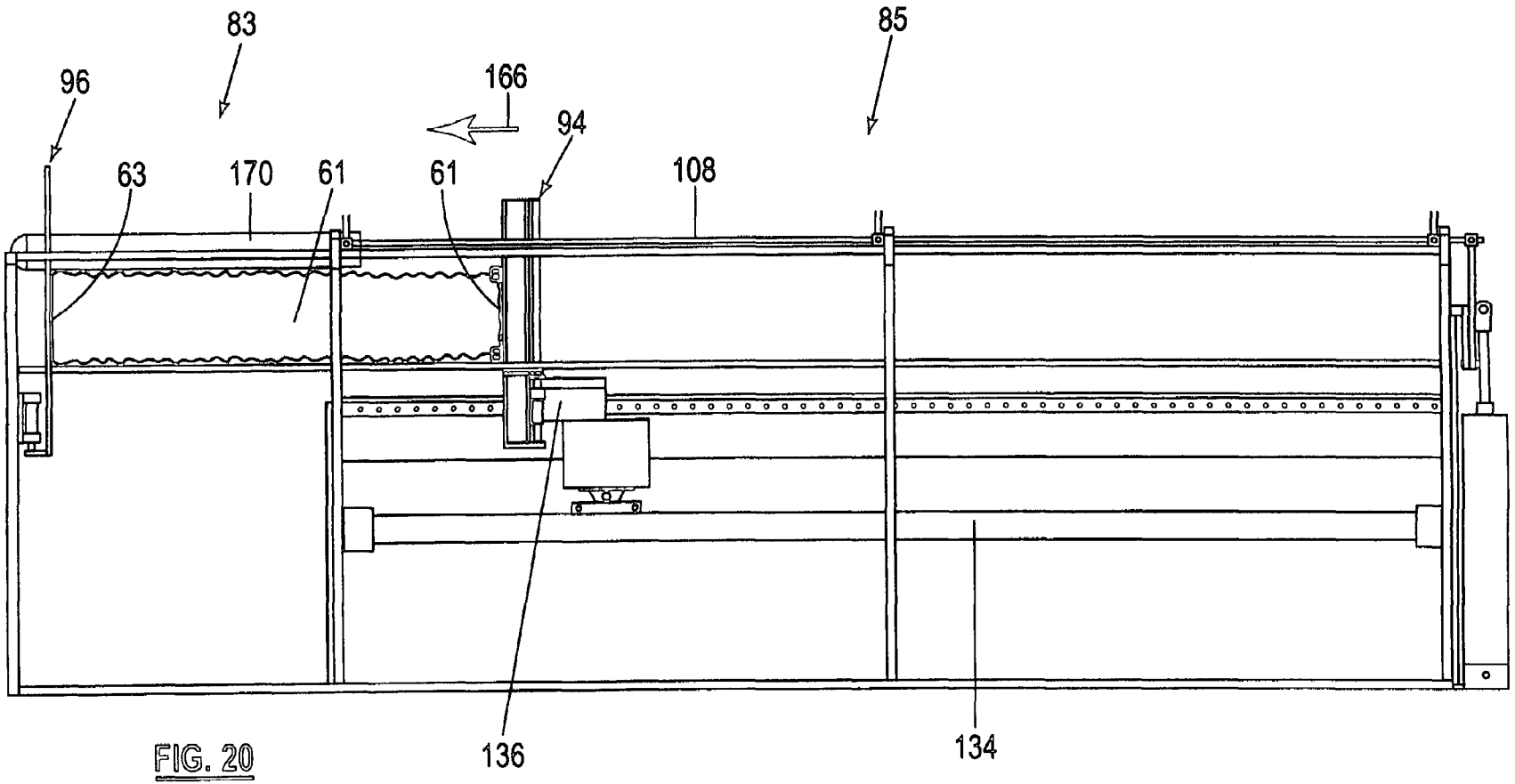
Figure 21:
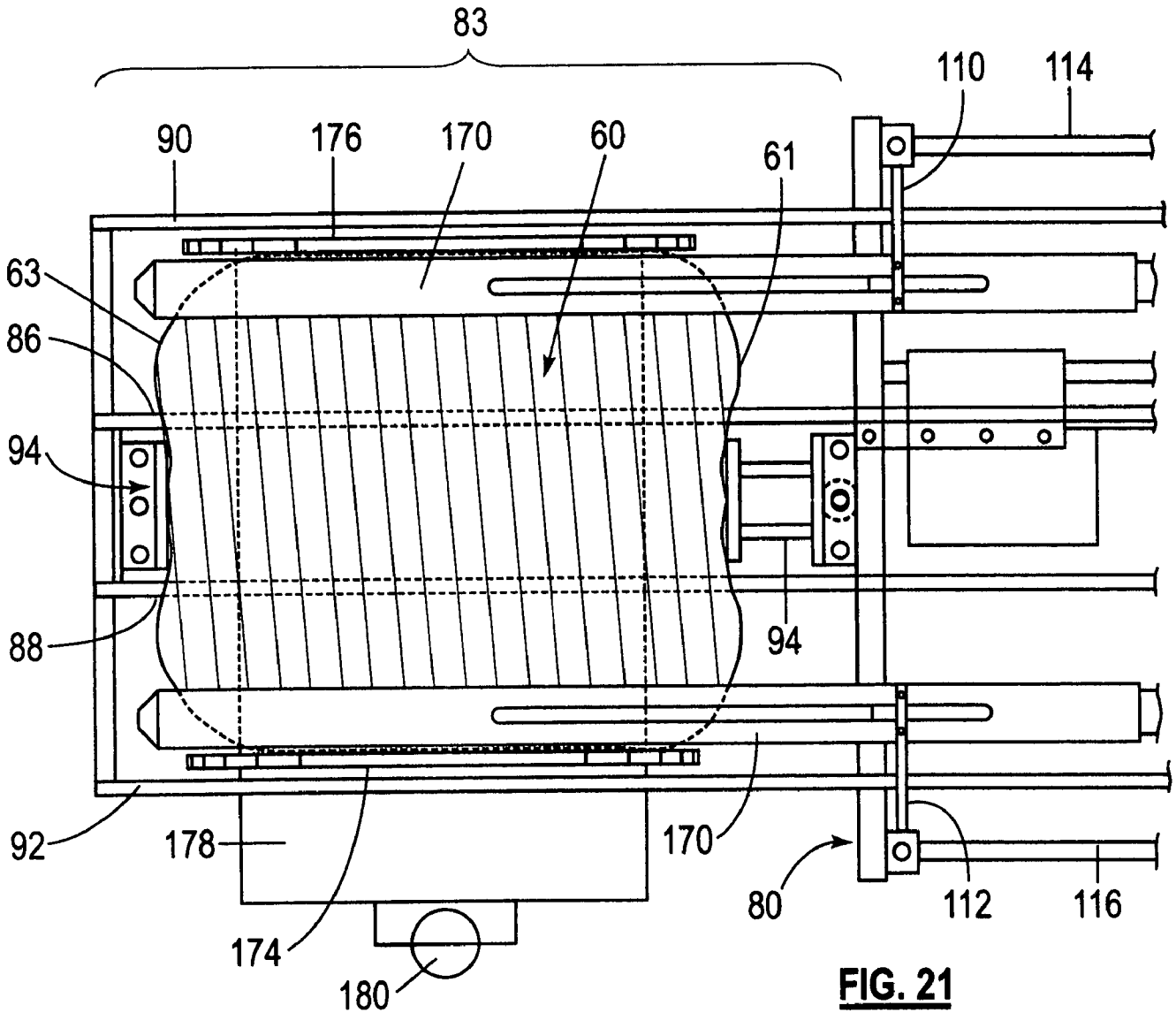

FIG. 17 diagrammatically illustrates the position of the leading end 61 of the duct held by the clamps 146 and 148. At this stage the actuating post 94 is in its elevated position and within the bagging station 83. The stop post 96 is in its lower position so as to allow the duct to pass over it. The operator then causes the ram 134 to execute an advancing stroke wherein the post 94 moves in the direction of arrow 160, as shown in FIG. 18. The duct is then carried into the compressing station 85 and is supported on the support plates 100 and 102. The duct is prevented from upward movement relative to the support plates by means of the guide bars 106 and 108. The advance stroke continues until the actuating post 94 reaches the far end of the compressing station 85, as illustrated in FIG. 19. At this point micro-switches or the like are activated in order to stop movement of the ram 134 and to release the clamps 146 and 148. At this point it will be seen that the trailing end 63 of the duct is located within the bagging station 83. The operator, or automatically at the end of the advance stroke, the stop post 96 is moved to its elevated position, as also shown in FIG. 19 and the clamps 146 and 148 open.

As best seen in FIG. 23, the apparatus includes a pair of guide rails 162 and an operating ram 164 in order to cause raising and lowering of the stop post 96 "(which is omitted for clarity of illustration in FIG. 23)". After raising of the stop post 96, the ram 134 is caused to move in the reverse direction so that the actuating post 94 moves in the direction of arrow 166 in a reverse stroke.

As best seen in FIG. 23, the elevating post includes a pair of guide rails 162 and an operating ram 164 in order to cause raising and lowering of the stop post 96. After raising of the stop post 96, the ram 134 is caused to move in the reverse direction so that the actuating post 94 moves in the direction of arrow 166 in a reverse stroke. In this stroke, the ducting is compressed, as diagrammatically illustrated in FIG. 20.

Figure 22:
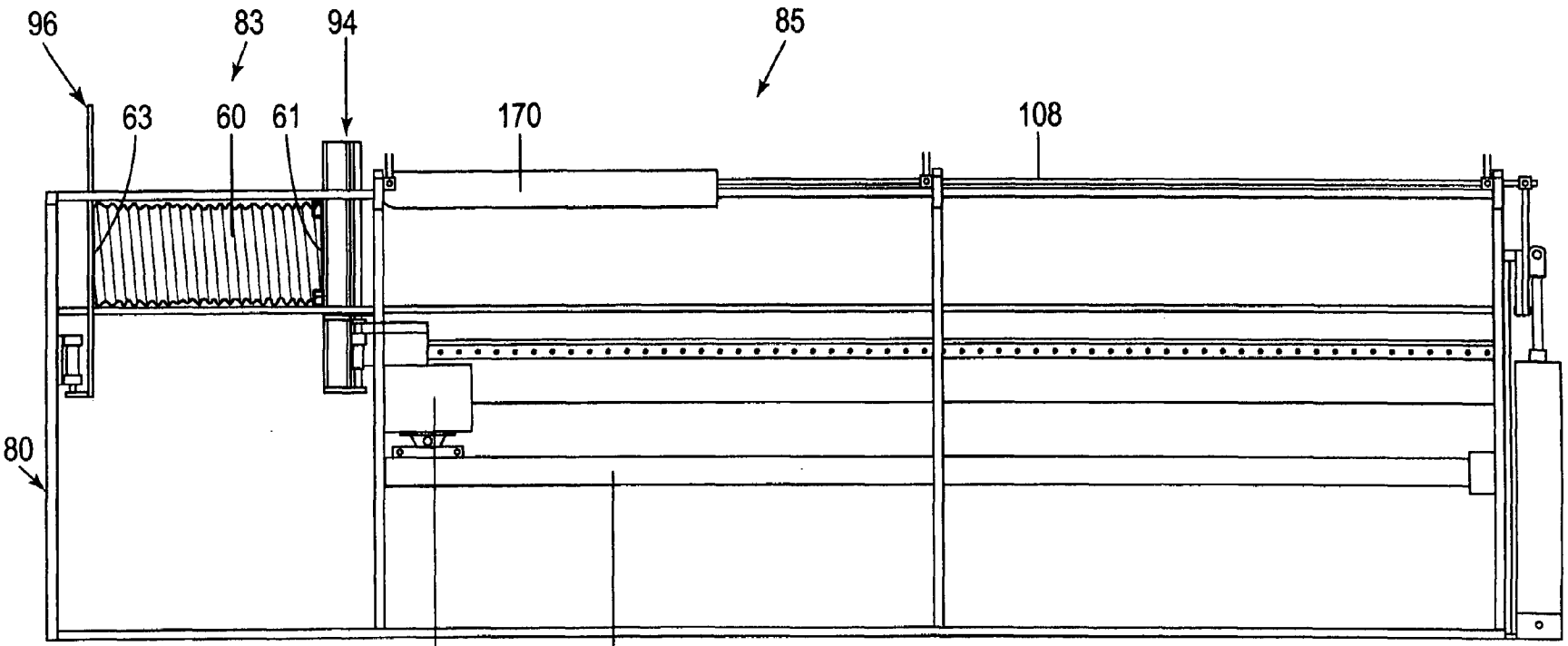
Figure 24:
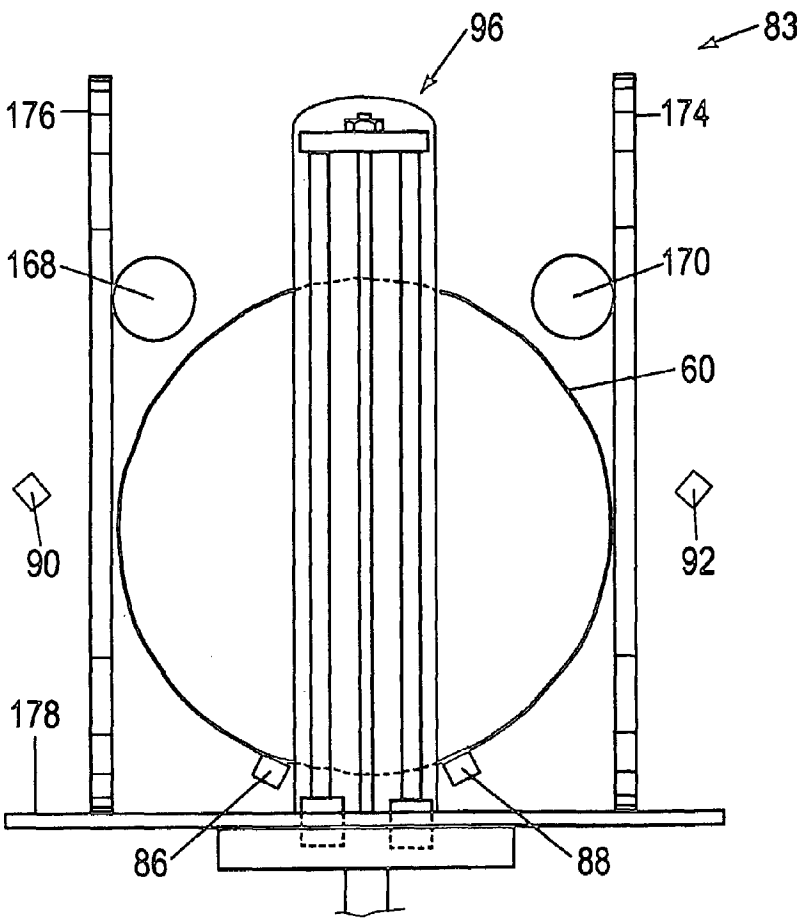
FIG. 24 is a schematic axial view of the bagging apparatus.

Prior to commencement of the reverse stroke, extensions 168 and 170 of the guide bars 106 and 108 are caused to move to positions in the bagging station 83, as also diagrammatically shown in FIGS. 19 and 24. The extensions 168 and 170 are tubular elements which are telescopically mounted on the ends of bars 106 and 108. The extensions 168 and 170 prevent the compressed bag buckling out of the bagging station during the reverse, compressing stroke. At the end of the compressing stroke, the actuating post 94 is again within the bagging station 83, as diagrammatically illustrated in FIG. 22. At this stage the length 60 of the duct is held in a highly compressed state between the actuating post 94 and the stop post 96 as shown in FIGS. 22 and 24. Micro-switches or the like may be provided to arrest movement of the ram 134 at the end of the reverse stroke. This causes retraction of the guide bar extensions 168 and 170 from the bagging station. An open mouthed plastic bag 172 can then be fitted over the compressed duct, as diagrammatically illustrated in FIG. 25.

In order to facilitate mounting of the bag 172 over the compressed duct, the bagging station 83 includes a pair of bag guide plate 174 and 176 which extend upwardly from a support platform 178. The support platform 178 is movable vertically by means of an operating ram 180, as seen in FIG. 23. The post 94 is movable independently relative to the support platform 178.

In order to facilitate mounting of the bag 172 over the compressed duct, the bagging station 83 includes a pair of bag guide plates 174 and 176 which extend upwardly from a support platform 178. The support platform 178 is movable vertically by means of an operating ram 180, as seen in FIG. 23. The post 94 is movable independently relative to the support platform 178. The port 94 has an internal ram (not shown) for raising and lowering the post.

Figure 27:
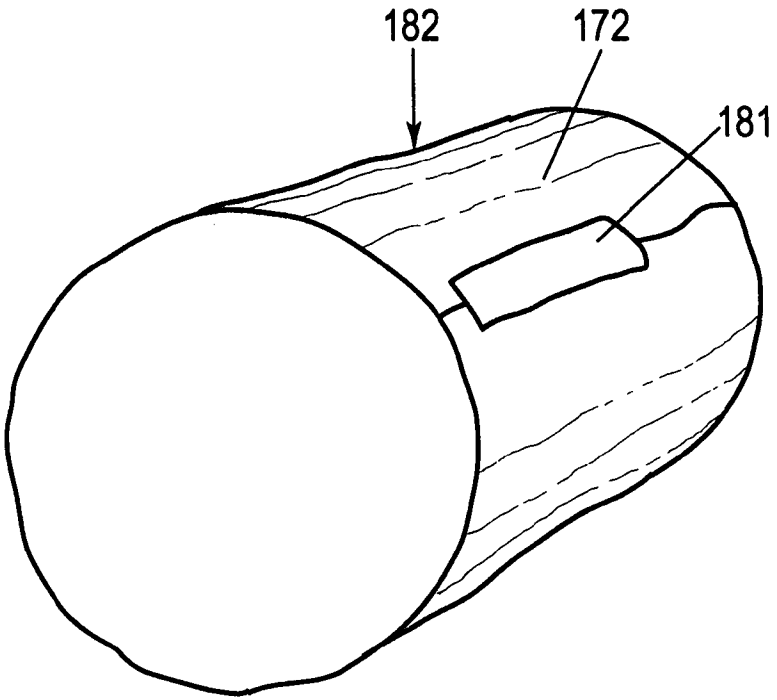
FIG. 27 is a perspective view of a bagged duct.
Figure 26:
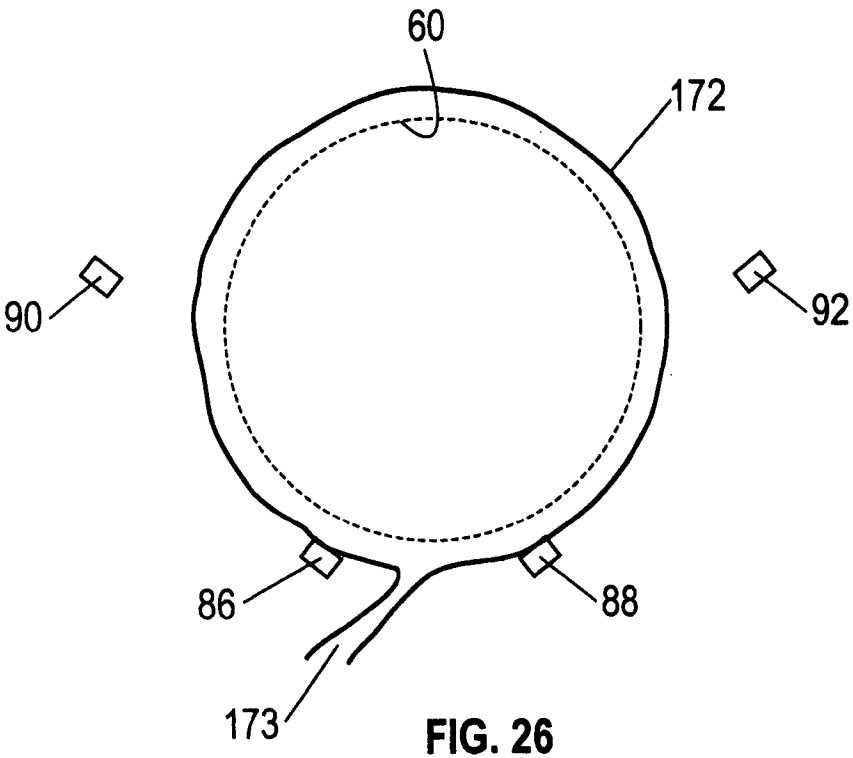
FIG. 26 is a schematic axial view of a compressed duct within the bag.

The guide plates 174 and 176 are arranged to be parallel to the beams 86 and 88 and in their upward position are located between respective pairs of beams, as shown in FIG. 24. The guide bar extensions 168 and 170 are also located between the guide plates 174 and 176, as shown in FIG. 24. As best seen in FIG. 23, the upper edges of the guide plates 174 and 176 are rounded and the outer faces smooth so as to facilitate movement of the mouth 173 of the bag thereover. Once the operator has moved the mouth of the bag to a position where it is adjacent to the platform 178, the ram 180 can be operated so as to cause lowering of the platform 178 which causes simultaneous lowering of the plates 174 and 176 and the posts 94 and 96. At this stage, the compressed ducting will tend to expand by virtue of the natural resilience of the insulating layer 12 and be held in a state of compression within the bag 172, as best shown in FIG. 26. At this stage, the bag 172 with the compressed ducting therein is supported in the bagging station by means of a cradle which is defined by the beams 86, 88, 90 and 92. The operator can then rotate the bag and apply a strip 181 of adhesive material along the mouth 173 of the bag in order to form a bagged ducted product 182, as shown in FIG. 27

It will be appreciated by those skilled in the art that the apparatus 2 of the invention enables very efficient production of bagged flexible ducting which is efficient in terms of minimising handling of the duct during production stages and minimising floor space required because the length 60 of duct can be brought directly into the compressing station 85 immediately after it is formed in the forming apparatus 4. It will be appreciated that in this arrangement no separate storage or floor space is required for the completed lengths of duct because they pass directly into the packaging apparatus 6.

In accordance with a preferred feature of the invention, a printing head 184 can be positioned in the bagging station 83. The printing head 184 can be operated when the actuating post 94 is executing its advance stroke, in the direction of arrow 160. Because the ram 134 will cause the post 94 and hence the length 60 of duct to move at substantially constant speed and in a non-compressed state, the printing head 184 can print directly onto the jacket 46 of the duct. The printing head may be a dot matrix printer or bar code printer or the like. Normally it is not possible to use these types of printers during the duct forming process because the duct is not moved at a constant speed.

Figure 25:
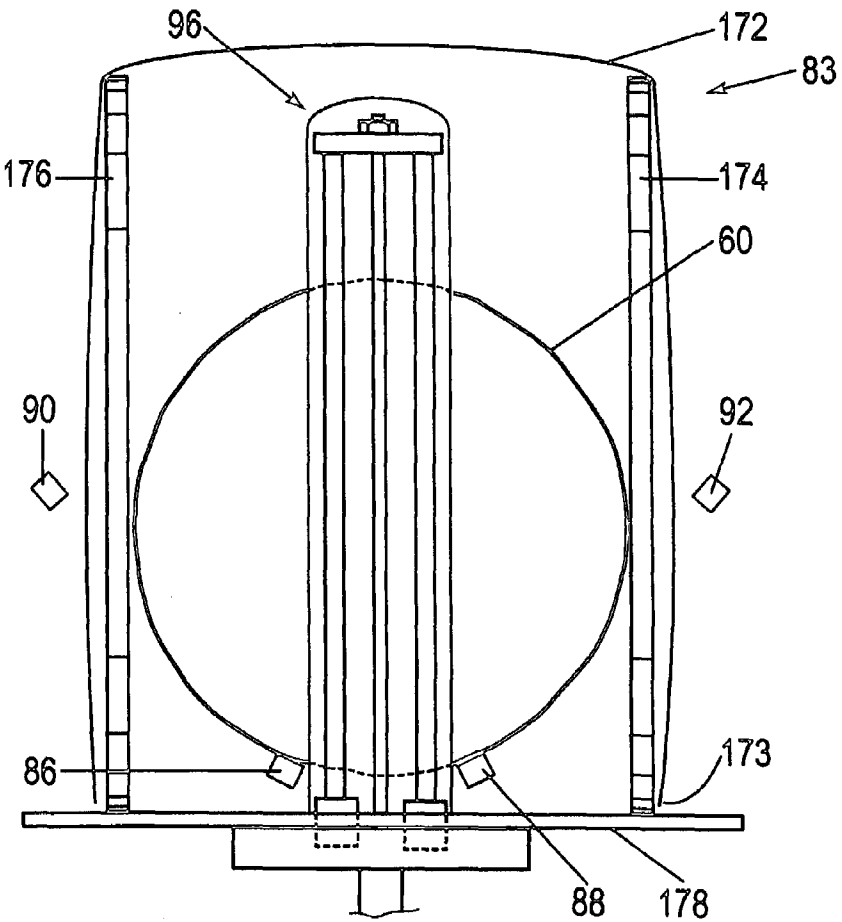
FIG. 25 is a fragmentary axial view of the bagging apparatus with a bag mounted over bag guide plates.

The apparatus of the invention can be used to produce ducts of various core diameters and lengths. Normally the diameters would be in the range 100 to 600 mm and the lengths would be in the range 3 to 6 m. Some adjustments would be required in order to handle these different sizes. For instance, the funnel 20 would need to be appropriately sized for the diameter of duct to be produced. Similarly, the guide bars 106 and 108 and extensions 168 and 170 thereof are also adjusted in position. Similarly, the spacing between the bag guide plates 174 and 176 can be adjusted as well so that the plates are, generally speaking, closely adjacent to the sides of the compressed duct, as shown in FIG. 25.

Many modifications will be apparent to those skilled in the art without departing from the spirit and scope of the invention.

The invention claimed is:

1. A method of packaging flexible ducting including the steps of:

pulling a leading end of a length of flexible ducting in a first direction through a packaging station into a compression station;

moving a stop member into the packaging station downstream of a trailing end of the length of flexible ducting;

pushing the leading end of the length of flexible ducting in a second direction opposite to the first direction so that the trailing end of the length of ducting is compressed against the stop member in the packaging station; and placing packaging material about the compressed length of flexible ducting in said packaging station.

2. A method as claimed in claim 1 including the step of operating clamps to grasp the leading end of the length of flexible ducting so that it can be pulled into the compression station.

3. A method as claimed in claim 1 including the steps of supporting upper parts of the length of flexible ducting whilst it is being compressed in the packaging station.

4. A method as claimed in claim 1 wherein the packaging material is a bag and including the steps of moving bag guide means to positions adjacent to the compressed length of flexible ducting in the packaging and placing a mouth of the bag over said bag guide means.

5. A method as claimed in claim 4 including the step of coupling the leading end of the length of flexible ducting to a longitudinally movable actuating member and wherein the length of flexible ducting is compressed between the stop member and the actuating member in the packaging station.

6. A method as claimed in claim 5 wherein a bag is placed over the bag guide means so that the compressed length of flexible ducting is located within the bag and then the bag guide means, stop member and actuating member are moved to retracted positions external to the bag so that the length of flexible ducting will expand within the bag and be retained therein.

7. A method as claimed in claim 1 wherein the length of flexible ducting is formed from a duct core, a jacket and insulating material located between the core and the jacket wherein said step of pulling a leading end of the length of flexible ducting causes wrapping of the insulating material about the duct core and application of the jacket to the duct core and insulating material.

8. Flexible ducting packaging apparatus including:

a packaging station and compression station;

support means for supporting the ducting in the packaging station and compression station;

the support means including a trough structure having an elongate opening therein and guide bars for providing support to upper parts of the ducting as it moves through the trough;

an actuating means including engagement means for engaging a leading end of a length of flexible ducting to be packed; and control means for:

(i) causing the actuating means to execute a first stroke in which the leading end of the end of the length of flexible ducting is pulled into the compression station and the length of ducting is pulled through the packaging station;

(ii) causing actuation of a stop member to move to an operative position in the packaging station downstream of a trailing end of the length of ducting; and (iii) causing the actuating means to execute a second stroke, in the opposite direction to the first stroke, so that said trailing end of the length of ducting abuts the stop member in its operative position and the length of ducting is compressed in the packaging station between the actuating means and the stop member, whereby packaging can be placed about the compressed length of flexible ducting in the packaging station; and wherein the actuating means includes an actuating post mounted for sliding movement relative to the trough during said first and second strokes, the post extending through the opening in the trough structure; and wherein the guide bars are mounted on support arms, the apparatus further including adjusting means for adjusting the position of the arms so that the apparatus can handle ducting of different sizes.

9. Apparatus as claimed in claim 8 wherein the support means includes downstream and upstream rollers for supporting the ducting in the compression station.

10. Apparatus as claimed in claim 9 wherein the support means includes guide bar extensions for providing support to upper parts of the ducting as it is compressed into the packaging station during said second stroke.

11. Apparatus as claimed in claim 9 wherein the stop member includes a stop post which is located adjacent to the downstream rollers and wherein the control means includes an actuator for moving the stop post between operative and retracted positions.

12. Apparatus as claimed in claim 11 wherein the packaging is a bag having a mouth and wherein the packaging station includes bag guide means disposed laterally of the compressed length of flexible ducting to facilitate placement of the mouth of the bag over said compressed length of flexible ducting.

13. Apparatus as claimed in claim 12 wherein the bag guide means includes first and second guide plates which are mounted for movement between operative and retracted positions and guide plate actuating means for selectively moving the guide plates between said positions.

14. Apparatus as claimed in claim 13 wherein the control means controls the guide plate actuating means such that the guide plates are in their retracted positions during said first and second strokes of the actuating post and are moved into their operative positions when the length of ducting is fully compressed between the actuating post and the stop post.

15. Apparatus as claimed in claim 14 wherein the actuating post is, at the end of its second stroke, movable between operative and retracted positions.

16. Apparatus as claimed in claim 15 wherein the control means is operable to simultaneously move the actuating and stop posts and the guide plates to their retracted positions whereby the ducting expands within the bag and will be retained therein.

17. Duct forming and packaging apparatus wherein the duct forming apparatus includes:

a wrapping zone;

first support means for supporting a roll of insulation material and permitting introduction of the insulating material to the wrapping zone in a longitudinal direction;

first forming means to cause the insulating material to generally assume a U-shape when viewed in said longitudinal direction;

second support means for supporting a duct core in a collapsed state and for guiding the duct core into engagement with the insulating material in an expanded state and extending generally parallel to the insulating material;

second forming means which causes the U-shaped insulating material to be substantially fully wrapped around the expanded duct core;

means for applying a jacket in a collapsed state about the duct core and insulating material; and packaging apparatus as claimed in claim 8 located adjacent to said second forming means whereby during said first stroke of the actuating means the duct core and insulation are pulled through the second forming means, the core and jacket being expanded to an expanded state, and the expanded jacket being applied over the expanded duct core and insulation.

18. Flexible ducting packaging apparatus including:

a packaging station and compression station;

support means for supporting the ducting in the packaging station and compression station;

an actuating means including engagement means for engaging a leading end of a length of flexible ducting to be packed; and control means for:

(i) causing the actuating means to execute a first stroke in which the leading end of the end of the length of flexible ducting is pulled into the compression station and the length of ducting is pulled through the packaging station;

(ii) causing actuation of a stop member to move to an operative position in the packaging station downstream of a trailing end of the length of ducting; and (iii) causing the actuating means to execute a second stroke, in the opposite direction to the first stroke, so that said trailing end of the length of ducting abuts the stop member in its operative position and the length of ducting is compressed in the packaging station between the actuating means and the stop member, whereby packaging can be placed about the compressed length of flexible ducting in the packaging station; and wherein the support means includes a trough structure for supporting the ducting in the compression station, the trough structure having an elongate opening therein and wherein the actuating means includes an actuating post mounted for sliding movement relative to the trough during said first and second strokes, the post extending through the opening in the trough structure; and wherein the engagement means includes upper and lower clamps which clamp onto upper and lower parts of the leading end of the length of flexible ducting.

19. Apparatus as claimed in claim 18 wherein the clamps are operated by actuating members in the actuating post.

* * * * *